US010996590B2

(12) United States Patent
Fujioka et al.

(10) Patent No.: US 10,996,590 B2
(45) Date of Patent: May 4, 2021

(54) IMAGE FORMING APPARATUS WITH BELT CLEANING DEVICE

(71) Applicant: CANON KABUSHIKI KAISHA, Tokyo (JP)

(72) Inventors: Ryota Fujioka, Kashiwa (JP); Tomohito Nakagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/904,691

(22) Filed: Jun. 18, 2020

(65) Prior Publication Data

US 2020/0319576 A1 Oct. 8, 2020

Related U.S. Application Data

(63) Continuation of application No. PCT/JP2018/042175, filed on Nov. 14, 2018.

(30) Foreign Application Priority Data

Dec. 20, 2017 (JP) ..... 2017-243646
Dec. 20, 2017 (JP) ..... JP2017-243647

(51) Int. Cl.
*G03G 15/10* (2006.01)
*G03G 15/16* (2006.01)
*G03G 21/00* (2006.01)

(52) U.S. Cl.
CPC ..... *G03G 15/10* (2013.01); *G03G 15/1615* (2013.01); *G03G 21/0088* (2013.01)

(58) Field of Classification Search
CPC ..... G03G 21/0088
See application file for complete search history.

(56) References Cited

U.S. PATENT DOCUMENTS

2009/0232536 A1 9/2009 Nishimura et al.
2010/0046990 A1 2/2010 Kamijo et al.
(Continued)

FOREIGN PATENT DOCUMENTS

JP 2002-318493 A 10/2002
JP 2005-099361 A 4/2005
(Continued)

OTHER PUBLICATIONS

JP_2009244840_A_T MachineTranslation, Japan, Oct. 2009, Nishimura.*
(Continued)

*Primary Examiner* — Victor Verbitsky
(74) *Attorney, Agent, or Firm* — Venable LLP

(57) ABSTRACT

An image forming apparatus includes an outer roller configured to form a contact portion that is in contact with an outer circumferential surface of a belt member, an inner roller configured to abut against the outer roller via the belt member, a first roller adjacent to the outer roller and the inner roller on a downstream side in a direction of movement of the belt member, and a second roller adjacent to the outer roller and the inner roller on an upstream side. At least a portion of at least one of the first and second rollers is provided on a same side as the outer roller with respect to a tangent passing an intersection of the inner roller and a straight line connecting a center of rotation of the outer roller and a center of rotation of the inner roller.

11 Claims, 16 Drawing Sheets

(56) References Cited

U.S. PATENT DOCUMENTS

| | | | | |
|---|---|---|---|---|
| 2011/0182611 | A1 | 7/2011 | Hofmann et al. | |
| 2017/0108803 | A1* | 4/2017 | Paul | G03G 15/10 |

FOREIGN PATENT DOCUMENTS

| | | | |
|---|---|---|---|
| JP | 2007-147974 | A | 6/2007 |
| JP | 2009-244840 | A | 10/2009 |
| JP | 2010-048847 | A | 3/2010 |
| JP | 2010-048848 | A | 3/2010 |
| JP | 2011-158905 | A | 8/2011 |

OTHER PUBLICATIONS

JP_2010048847_A_T MachineTranslation, Japan, Mar. 2010, Kamijo.*
International Search Report dated Jan. 15, 2019, in International Patent Application No. PCT/JP2018/042175.

* cited by examiner

IMAGE FORMING APPARATUS WITH BELT CLEANING DEVICE

CROSS-REFERENCE TO RELATED APPLICATIONS

This application is a Continuation of International Patent Application No. PCT/JP2018/042175, filed Nov. 14, 2018, which claims the benefit of Japanese Patent Application No. 2017-243647, filed Dec. 20, 2017 and Japanese Patent Application No. 2017-243646, filed Dec. 20, 2017, which are hereby incorporated by reference herein in their entirety.

BACKGROUND OF THE INVENTION

Field of the Invention

The present invention relates to an image forming apparatus adopting an electrophotographic system for forming an image using a liquid developer.

Description of the Related Art

Hitherto, there has been known an image forming apparatus that develops an electrostatic latent image formed on a photosensitive drum as a toner image using liquid developer containing toner and carrier liquid, and primarily transferring the developed toner image to a transfer drum then secondarily transferring the primarily transferred toner image on the transfer drum to a recording material. In an apparatus using liquid developer, a cleaning roller abuts against the transfer drum to remove toner remaining on the transfer drum after performing secondary transfer (Japanese Patent Application Laid-Open No. 2011-158905). Toner moves from the transfer drum to the cleaning roller via the liquid developer according to an electric field formed by the application of voltage to a cleaning roller, which is so-called electrophoresis, at a nip portion formed by the cleaning roller abutting against the transfer drum. The toner moved to the cleaning roller is removed with the liquid developer by a cleaning blade that is rubbed against the cleaning roller.

Meanwhile, an image forming apparatus using a dry developer instead of a liquid developer is proposed, where a counter roller is arranged on an inner side of the belt and a cleaning roller is arranged on an outer side of the belt as a pair of rollers for removing the toner remaining on the intermediate transfer belt. In these apparatuses, the counter roller and the cleaning roller are arranged so that the intermediate transfer belt nipped by the counter roller and the cleaning roller is projected either toward the inner side or the outer side of the belt (Japanese Patent Application Laid-Open Nos. 2002-318493 and 2005-99361).

In the case of the image forming apparatus using liquid developer, it is desirable to use a metal roller as the cleaning roller for cleaning the intermediate transfer belt, since it has higher resistance than a rubber roller to deterioration by organic solvent and the like contained in the liquid developer. However, if the metal roller was used, there was a case where toner could not be moved from the intermediate transfer belt. In the image forming apparatus using a liquid developer, there was a demand to ensure a nip portion enabling toner to move by electrophoresis from the belt member such as the intermediate transfer belt, but there has been no proposal of such an apparatus.

SUMMARY OF THE INVENTION

According to a first aspect of the present invention, an image forming apparatus includes an endless belt member configured to bear a liquid developer including toner and carrier liquid on an outer circumferential surface and rotate, an outer roller configured to form a contact portion that is in contact with the outer circumferential surface of the belt member and receive toner moved from the belt member via the liquid developer, an inner roller configured to abut against the outer roller via the belt member, a power supply configured to apply voltage to the outer roller or the inner roller, a first roller adjacent to the outer roller and the inner roller on a downstream side in a direction of movement of the belt member and configured to tension the belt member, and, a second roller adjacent to the outer roller and the inner roller on an upstream side in the direction of movement of the belt member and configured to tension the belt member. At least a portion of at least one of the first and second rollers is provided on a same side as the outer roller with respect to a tangent passing an intersection of the inner roller and a straight line connecting a center of rotation of the outer roller and a center of rotation of the inner roller.

According to a second aspect of the present invention, an image forming apparatus includes an endless belt member configured to bear a liquid developer including toner and carrier liquid on an outer circumferential surface and rotate, an outer roller configured to form a contact portion that is in contact with the outer circumferential surface of the belt member and receive toner via the liquid developer from the belt member according to a potential difference generated between the belt member, a first roller adjacent to the outer roller and the inner roller on a downstream side in a direction of movement of the belt member and configured to tension the belt member, the first roller being positioned so that a position in which the first roller abuts against the belt member does not overlap with the contact portion with respect to a direction of movement of the belt member, and a second roller adjacent to the outer roller and the inner roller on an upstream side in the direction of movement of the belt member and configured to tension the belt member, the second roller being positioned so that a position in which the second roller abuts against the belt member does not overlap with the contact portion with respect to the direction of movement of the belt member. At least one of the first and second rollers is provided on a same side as the outer roller with respect to a tangent of the outer roller at a center position of the contact portion with respect to the direction of movement of the belt member.

Further features of the present invention will become apparent from the following description of exemplary embodiments with reference to the attached drawings.

DESCRIPTION OF THE EMBODIMENTS

First Embodiment

Image Forming Apparatus

Figure 1:
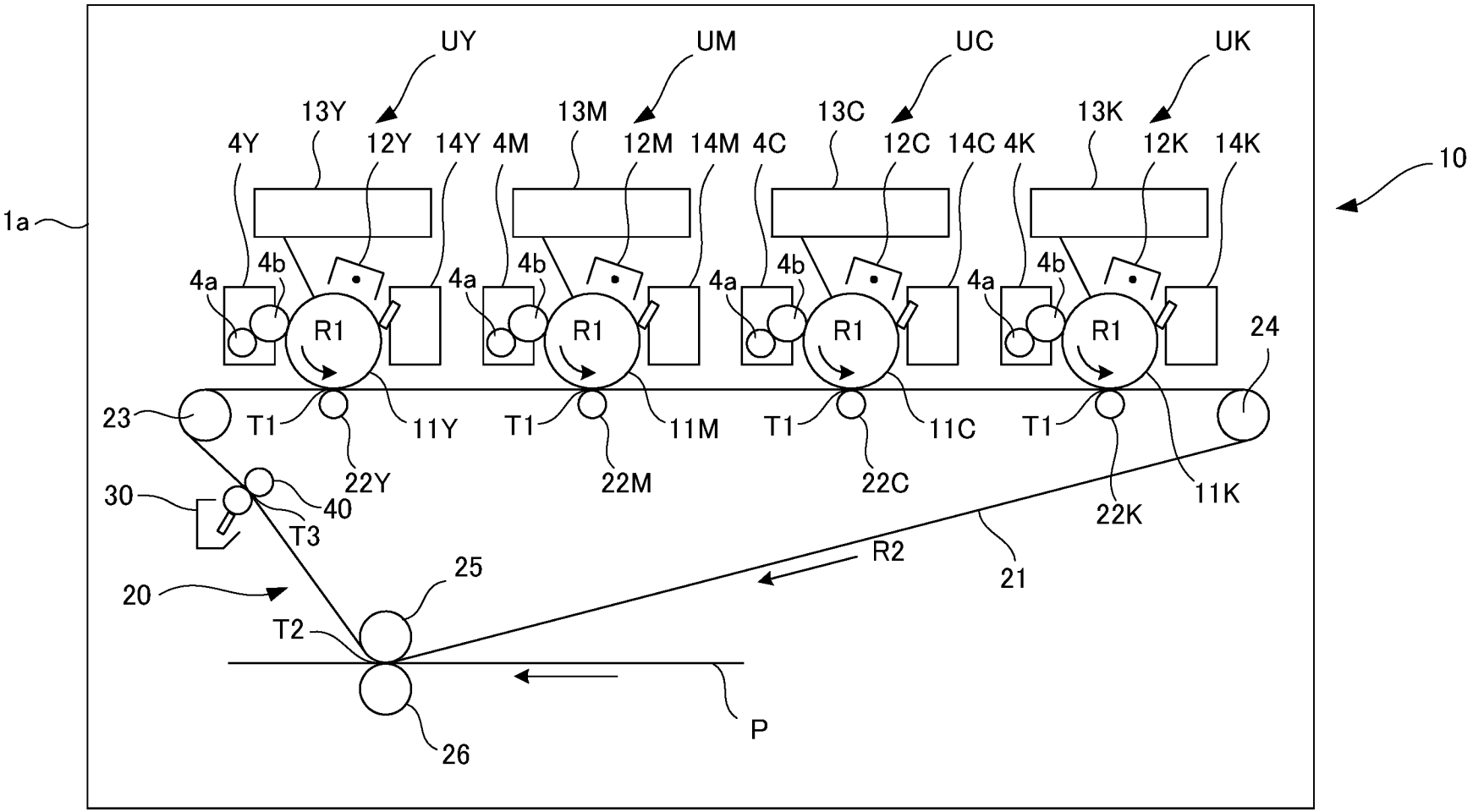
FIG. 1 is a schematic drawing illustrating a configuration of an image forming apparatus according to a present embodiment.

A first embodiment will be illustrated. First, a configuration of an image forming apparatus according to the present embodiment will be described with reference to FIG. 1. An image forming apparatus 10 illustrated in FIG. 1 is a full color printer adopting a tandem-type intermediate transfer system where a plurality of image forming units UY, UM, UC and UK are arranged. According to the present embodiment, an intermediate transfer unit 20 is arranged downward in a gravity direction of a plurality of image forming units UY to UK.

The intermediate transfer unit 20 includes an endless intermediate transfer belt 21 serving as a belt member, primary transfer rollers 22Y to 22K, a driving roller 23, a tension roller 24 and a secondary transfer inner roller 25. The intermediate transfer belt 21 is wound around and supported by rollers including the driving roller 23, the tension roller 24 and the secondary transfer inner roller 25 and driven by the driving roller 23 to rotate in a direction of arrow R2 of FIG. 1. In the present embodiment, the secondary transfer inner roller 25 is fixed rotatably on an inner circumferential side of the intermediate transfer belt 21 and tensions the intermediate transfer belt 21. Meanwhile, the driving roller 23 is fixed rotatably on the inner circumferential side of the intermediate transfer belt 21 and tensions the intermediate transfer belt 21 at a position downstream of the secondary transfer inner roller 25 in a direction of movement of the intermediate transfer belt 21.

The image forming units UY to UK are arranged along the direction of movement of the intermediate transfer belt 21, that is, in the direction of arrow R2 of FIG. 1. In the image forming unit UY, a yellow toner image is formed on a photosensitive drum 11Y and transferred to the intermediate transfer belt 21. In an image forming unit UM, a magenta toner image is formed on a photosensitive drum 11M and transferred to the intermediate transfer belt 21. In the image forming units UC and UK, a cyan toner image and a black toner image are respectively formed on photosensitive drums 11C and 11K and transferred to the intermediate transfer belt 21. The four-color toner image transferred to the intermediate transfer belt 21 is conveyed to a secondary transfer portion T2 and collectively transferred to a recording material P, which is a sheet material such as paper of an OHP sheet. In the present embodiment, the intermediate transfer belt 21 bears liquid developer containing toner and carrier liquid and rotates.

The image forming units UY to UK adopt a similar configuration except for the different toner colors of yellow, magenta, cyan and black used in developing apparatuses 4Y, 4M, 4C and 4K serving as supplied portions receiving supply of toner. Therefore, in the following description, the letters Y, M, C and K as suffixes indicating the distinction of image forming units UY, UM, UC and UK are omitted in illustrating the configuration and action of the image forming units UY to UK.

The image forming unit U includes a primary charger 12, an exposing unit 13, a developing apparatus 4 and a drum cleaning device 14 arranged in a manner surrounding a photosensitive drum 11 serving as a photosensitive member. The image forming unit U is arranged so that the photosensitive drum 11 opposes to a primary transfer roller 22 with the intermediate transfer belt 21 interposed therebetween so that a primary transfer portion T1 of toner image is formed between the photosensitive drum 11 and the intermediate transfer belt 21 by the primary transfer roller 22. The photosensitive drum 11 in which a photosensitive layer is formed on an outer circumferential surface of an aluminum cylinder is rotated in a direction of arrow R1 of FIG. 1 by a predetermined process speed.

The primary charger 12 irradiates charged particles accompanying corona discharge to charge the photosensitive drum 11 to uniform negative dark potential. The exposing unit 13 scans an ON-OFF modulated laser beam of image data of scanning lines having developed separate color images of respective colors using a rotation mirror and writing an electrostatic latent image of an image on a charged surface of the photosensitive drum 11. The electrostatic latent image is developed into a toner image by the developing apparatus 4.

Liquid developer including powder toner serving as dispersoid dispersed in carrier liquid serving as dispersion medium is stored in the developing apparatus 4. Liquid developer supplied from a mixer (not shown) is supplied to the developing apparatus 4. Liquid developer supplied from the mixer to the developing apparatus 4 is coated, i.e., supplied, to a developing roller 4*b* by a coating roller 4*a* in the developing apparatus 4, which is used to develop an image. The developing roller 4*b* bears and conveys liquid developer on its surface, and the electrostatic latent image formed on the photosensitive drum 11 is developed using toner. Coating of liquid developer to the developing roller 4*b* from the coating roller 4*a* and developing of electrostatic latent image from the developing roller 4b on the photosensitive drum 11 are respectively performed using an electric field. Liquid developer that has not been used for developing image is returned to the mixer from the developing apparatus 4 to the mixer and reused.

The toner image formed on the photosensitive drum 11 is primarily transferred to the intermediate transfer belt 21 using an electric field at the primary transfer portion T1 formed by the primary transfer roller 22. Liquid developer, i.e., toner and carrier liquid, remaining on the photosensitive drum 11 after primary transfer is collected by the drum cleaning device 14.

The secondary transfer portion T2 is a transfer portion formed by abutting a secondary transfer outer roller 26 to the intermediate transfer belt 21 supported by the secondary transfer inner roller 25 for transferring toner image to the recording material P. By applying secondary transfer voltage to the secondary transfer outer roller 26 serving as a transfer member at the secondary transfer portion T2, toner image is secondarily transferred from the intermediate transfer belt 21 to the recording material P conveyed to the secondary transfer portion T2. Toner, i.e., residual toner, remaining on the intermediate transfer belt 21 after primary transfer is removed together with carrier liquid by a belt cleaning device 30. The belt cleaning device 30 will be described in detail later (refer to FIG. 2A).

The recording material P to which a toner image of four colors is secondarily transferred at the secondary transfer portion T2 is conveyed to a fixing unit and the like (not shown), and the toner image transferred to the recording material P is fixed by the fixing unit. The recording material P to which the toner image has been formed is discharged to an exterior of the apparatus body.

Liquid Developer

Next, liquid developer used in developing apparatuses 4Y to 4K will be described. Conventional liquid developer may be used as liquid developer, and a UV-curing liquid developer is used according to the present embodiment.

The liquid developer is a UV-curing liquid developer containing cation-polymerizable liquid monomer, photopolymerization initiator and toner particles insoluble to cation-polymerizable liquid monomer. Further, the cation-polymerizable liquid monomer is a vinyl ether compound and the photopolymerization initiator is a chemical compound represented by the following general formula (Chem. 1).

General Formula (1)

Chem. 1

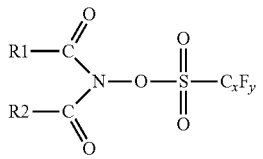

A more specific description follows. First, the toner particles contain toner resin enclosing a coloring material that generates color. Further, the toner particles may contain other materials such as a charge control agent in addition to toner resin and coloring material. A known technique such as a coacervation method in which coloring materials are dispersed and resin is caused to gradually polymerize and enclose the coloring materials or an internal pulverization method in which resin and the like is melted and the coloring material is caused to be enclosed in resin can be adopted as the manufacturing method of toner particles. Epoxy resin, styrene acrylic resin and the like can be used as toner resin. The coloring material for generating color may be general organic/inorganic pigments. Dispersing agent is used to enhance toner dispersibility during manufacture, but synergist may also be used.

Curing liquid serving as carrier liquid is composed of a charge control agent for charging the toner surface, a photopolymerization agent that generates acid by UV irradiation and a monomer bound by acid. The monomer is a vinyl ether compound that is polymerized by cation polymerization reaction. Further, a sensitizer may be contained in addition to the photopolymerization agent. Preservability is deteriorated by photopolymerization, so that 10 to 5000 ppm of cation polymerization inhibitor may be added. A charge controlling agent or other additives may also be added.

UV curing agent (monomer) of the above-described developer is a mixture containing approximately 10% (wt. %) of monofunctional monomer having one vinyl ether group represented by chemical formula (Chem. 2) and approximately 90% of difunctional monomer having two vinyl ether groups represented by chemical formula (Chem. 3).

Chem. 2

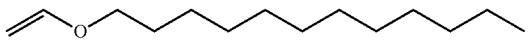

Chem. 3

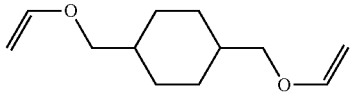

An agent represented by chemical formula (Chem. 4) is mixed for 0.1% as a photopolymerization initiator. Unlike the case where an ionic photoacid generator is used, a high resistivity liquid developer may be obtained while ensuring preferable fixture, by using the photopolymerization initiator.

Chem. 4

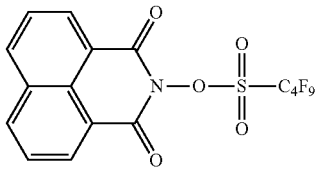

The cation-polymerizable liquid monomer should preferably be a chemical compound selected from a group consisting of dicyclopentadiene vinyl ether, cyclohexane dimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether and 1,2-decanediol vinyl ether.

Further, a known charge control agent can be utilized. Specific chemical compounds include fats and oils such as linseed oil and soybean oil; metal soaps such as alkyd resin, halogen polymer, aromatic polycarboxylic acid, acid group-containing water soluble dye, oxidative condensate of aromatic polyamine, cobalt naphthenate, nickel naphthenate, iron naphthenate, zinc naphthenate, cobalt octylate, nickel octylate, zinc octylate, dodecyl acid cobalt, dodecyl acid nickel, dodecyl oxide zinc, aluminum stearate and 2-ethylhexanoic acid cobalt; sulfonic acid metal salt such as petroleum-based sulfonate metal salt and metal salt of sulfosuccinic acid ester; phospholipid such as lecithin; salicyclic metal salts such as t-butylsalicylate metal complex; and polyvinyl pyrrolidone resin, polyamide resin, sulfonic acid-containing resin and hydroxybenzoic acid derivatives.

Belt Cleaning Device

Figure 2A:
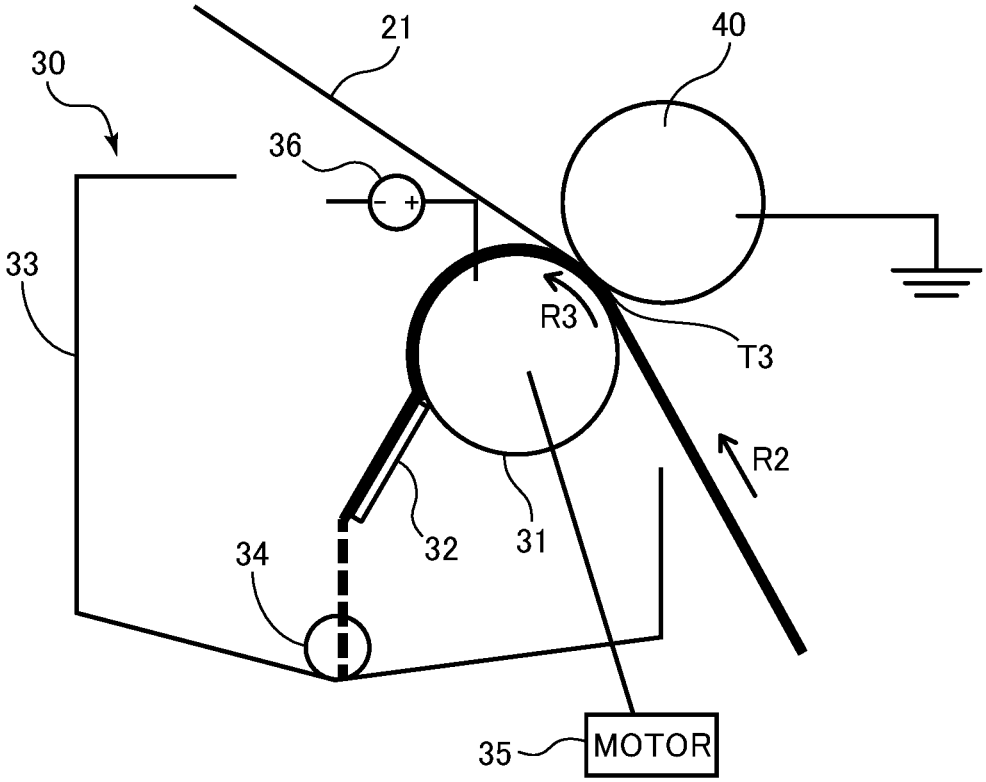
FIG. 2A is a schematic drawing illustrating a belt cleaning device according to the present embodiment.

The configuration of the belt cleaning device 30 according to the present embodiment will be described with reference to FIGS. 2A and 2B. As illustrated in FIG. 2A, the belt cleaning device 30 includes a cleaning container 33 that constitutes a casing, a cleaning roller 31, a cleaning blade 32, a counter roller 40 and so on.

The counter roller 40 serving as an inner roller is provided rotatably on an inner circumferential side of the intermediate transfer belt 21, and abuts against the inner circumferential surface, i.e., rear surface, of the intermediate transfer belt 21 between the secondary transfer inner roller 25 and the driving roller 23 (refer to FIG. 1) with respect to the direction of movement (direction of arrow R2) of the intermediate transfer belt 21. The counter roller 40 is driven to rotate by the movement of the intermediate transfer belt 21. The cleaning container 33 has an opening formed at a part opposed to the intermediate transfer belt 21, and the cleaning roller 31 is provided rotatably so as to be exposed through this opening. The cleaning roller 31 serving as an outer roller is arranged to oppose to the counter roller 40 with the intermediate transfer belt 21 interposed therebetween and abut against the outer circumferential surface, i.e., outer surface, of the intermediate transfer belt 21. The counter roller 40 and the cleaning roller 31 respectively abut against the inner and outer circumferential surfaces of the intermediate transfer belt 21, thereby forming a cleaning nip portion T3, hereinafter simply referred to as a nip portion T3, serving as a contact portion. In the present embodiment, the nip portion T3 is formed by winding the intermediate transfer belt 21 around the cleaning roller 31 so that a physical nip T3*b* and a tension nip T3*a* illustrated in FIG. 2B are formed. In the present specification, the physical nip T3*b* serving as a first contact portion denotes an area, i.e., abutment area, where the counter roller 40 and the cleaning roller 31 abut against front and rear sides of the intermediate transfer belt 21. The cleaning roller 31 abuts against the intermediate transfer belt 21 at a front side of the abutment area and the counter roller 40 at a rear side of the abutment area. The tension nip T3*a* serving as a second contact portion denotes an area where the counter roller 40 is not in contact therewith and only the cleaning roller 31 abuts against the intermediate transfer belt 21.

The present embodiment is configured to enable the physical nip T3*b* to be ensured by the counter roller 40 and the cleaning roller 31. The reason for adopting this arrangement is to suppress the generation of discharge that tends to occur near the nip portion T3 as much as possible. If discharge occurs near the nip portion T3, a stronger electric field is required to clean the toner on the intermediate transfer belt 21, which may lead to increased damaging of the intermediate transfer belt 21. The present embodiment adopts an elastic belt having an elastic layer as the intermediate transfer belt 21, as described later. Such an intermediate transfer belt 21 has a high electrical resistivity, so discharge especially tends to occur near the nip portion T3.

The cleaning roller 31 is driven to rotate by a motor 35 at a similar speed as the intermediate transfer belt 21 in a same direction (direction of arrow R3) as the direction of movement of the intermediate transfer belt 21 at the nip portion T3 with the intermediate transfer belt 21. By operation of electric field, the cleaning roller 31 electrically removes the toner remaining on the intermediate transfer belt 21 without being secondarily transferred, which is so-called electrophoresis. In the case of the present embodiment, the counter roller 40 is grounded and the cleaning roller 31 is connected to a power supply 36, and voltage having an opposite polarity as toner is applied to the cleaning roller 31 from the power supply 36. It is also possible to connect the power supply to the counter roller 40 and ground the cleaning roller 31. In that case, voltage having the same polarity as toner is applied to the counter roller 40. Then, toner remaining on the intermediate transfer belt 21 is moved from the intermediate transfer belt 21 to the cleaning roller 31 via a solution layer of liquid developer formed between the intermediate transfer belt 21 and the cleaning roller 31 at the nip portion T3.

The toner moved to the cleaning roller 31 is removed together with liquid developer by the cleaning blade 32. The cleaning blade 32 is a plate-like member made of metal such as stainless steel and abuts against the cleaning roller 31 at a downstream side of the nip portion T3 with respect to the direction of movement of the cleaning roller 31. Toner having been removed by the cleaning blade 32 flows down into the cleaning container 33 with liquid developer by gravity. The bottom surface of the cleaning container 33 is formed in an inclined shape, and a discharge port 34 is formed at a lowermost portion of the inclined bottom surface. Therefore, the liquid developer containing toner removed by the cleaning blade 32 flows along the bottom surface of the cleaning container 33 to the discharge port 34 and is discharged through the discharge port 34 to the exterior of the cleaning container 33.

Cleaning Roller

The above-described cleaning roller 31 will be described. In an image forming apparatus using liquid developer, it is preferable to form the cleaning roller 31 using a material that does not easily react to organic solvents and the like contained in the liquid developer. Durability of the roller is thereby enhanced by suppressing deterioration of the roller due to dissolution and alteration caused by the chemical compound contained in the carrier liquid. Generally, if the difference between solubility parameters (SP value) of the roller and the organic solvent is two or more, the roller tends to deteriorate, that is, roller degradation is advanced, compared to the case where the difference between SP values is less than two. In the present embodiment, a metal roller formed for example of stainless steel or aluminum is used as the cleaning roller 31 from the viewpoint of delaying deterioration of the roller. A metal roller having a thin surface coating of fluororesin and the like that is thin enough so that shape following property of the metal roller is not changed by deformation may be used. It is not always necessary to use a metal roller as the counter roller 40 since it has less opportunity to be in contact with liquid developer than the cleaning roller 31, so a rubber roller can be used as the counter roller 40. However, it is preferable to use a metal roller for the counter roller 40 from the viewpoint of roller deterioration.

In the case of an image forming apparatus using dry developer, it is difficult to adopt a metal roller as the cleaning roller 31. Toner contained in a dry developer is an insulator, and if the cleaning roller 31 is a metal roller having low electrical resistivity, discharge caused at the nip portion or a gap at the area close thereto may cause melting and adhesion of toner having opposite polarity. Thereby, the cleaning property is deteriorated. In contrast, in the case of the image forming apparatus using liquid developer, the polarity of toner will not be reversed even if discharge occurs. Since toner will move in the solution layer of liquid developer by electrophoresis, a metal roller may be used. However, the metal roller has very little shape followability by deformation compared to the rubber roller. Therefore, if a metal roller is used as the cleaning roller 31, a certain nip length of the nip portion T3, that is, the length of the nip in the direction of movement of the intermediate transfer belt 21, must be ensured to allow the toner to move by electrophoresis infallibly. As described in detail later (refer to FIG. 5), the cleaning roller 31 is projected inwardly from the intermediate transfer belt 21 so that the intermediate transfer belt 21 is wound around the cleaning roller 31 and a nip length of the nip portion T3 is ensured.

Intermediate Transfer Belt

We will now describe the intermediate transfer belt 21. The intermediate transfer belt 21 is formed in the shape of a film having a fixed thickness using resin such as polyimide or polyamide or an alloy thereof that contains an appropriate amount of antistatic agent such as carbon black. For example, the intermediate transfer belt 21 is a resin belt having a surface resistivity of 1E+9 to 1E+13 Ω/□ and a thickness of 0.04 to 0.1 mm The intermediate transfer belt 21 is formed of a resin having a high Young's modulus (such as 300 MPa). In the case of the intermediate transfer belt 21 having a low Young's modulus and is easily deformed, a long nip length of the physical nip T3*b* can be obtained even if a metal roller is used. However, if the thickness of the intermediate transfer belt 21 is 1 mm or less, it is difficult to ensure a sufficient nip length to remove most of the toner unless a metal roller having a diameter larger than 40 mm is used. A nip length of 1.2 mm or more must be ensured, for example. However, considering the fact that the weight of the metal roller is increased in squares if the diameter is increased, it is preferable to use a metal roller having a diameter of 40 mm or less as the cleaning roller 31.

Figure 3:
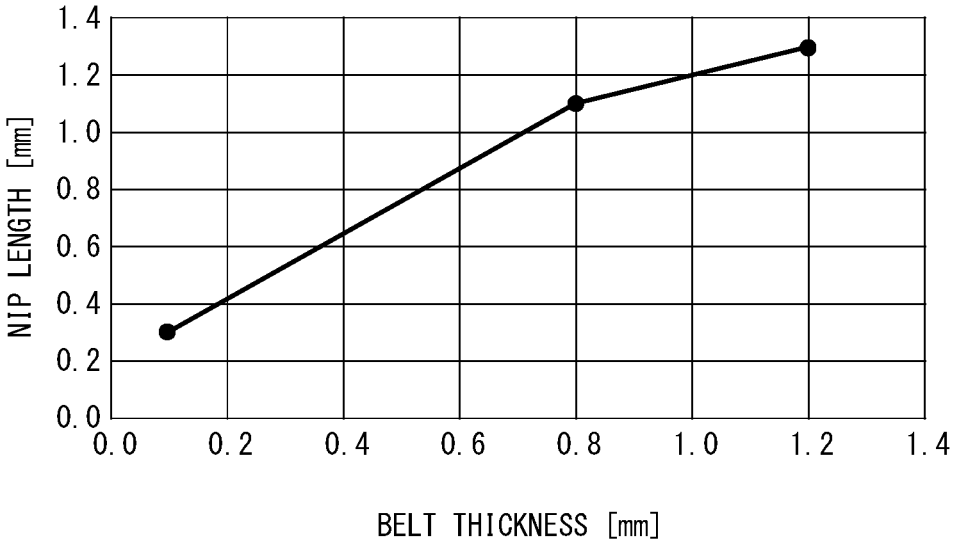
FIG. 3 is a graph illustrating a relationship between belt thickness and nip length.

Now, a test for examining the nip length while varying the belt thickness was performed to the nip length of the nip portion formed in a state where a metal roller is pressed against an endless belt. The result of the test is illustrated in FIG. 3. In FIG. 3, the horizontal axis denotes belt thickness and the vertical axis denotes nip length. Elastic belts composed of a resin belt formed of polyimide having a thickness of 0.1 mm and an elastic layer formed of a urethane sponge having a thickness of 0.8 mm or a thickness of 1.2 mm arranged on the resin belt were prepared, and respective nip lengths were measured. The contact pressure of the belt to the metal roller was 80 N and the length of the belt in the direction of movement, that is, the longitudinal direction, was 400 mm. Further, the Young's modulus of the elastic layer was 0.3 (MPa). The Young's modulus can be measured by "FISCHERSCOPE HM2000S" (Fischer Instruments K.K.).

As illustrated in FIG. 3, a nip length, such as 12 mm, sufficient to remove toner with a contact pressure of 80 N could not be ensured unless the belt thickness is 1 mm or more. Therefore, one idea is to increase the contact pressure to 80 N or more to ensure sufficient nip length for removing toner. However, too much contact pressure will cause the belt to be damaged. The present embodiment limits the maximum contact pressure to 300 N. Especially if an elastic belt is used as the intermediate transfer belt that bears liquid developer, minute cracks may occur by the expansion and compression of the belt by the metal roller being pressed against the belt, and liquid developer may enter the cracks causing swelling of the belt or variation of electric resistivity of the belt. In order to prevent this drawback, a belt having a thin elastic layer with a thickness of 1 mm or less should preferably be used as the intermediate transfer belt 21. Further, if the contact pressure is too low, it may be possible that the distance between the belt and the counter roller 40 or the cleaning roller 31 may be increased by uneven belt thickness or uneven drive during rotation. If this occurs, necessary physical nip width or tension nip width is lost and the cleaning performance is deteriorated. Therefore, the contact pressure should be as low as possible, such as 30 N, but not too low so as not to cause deviation of the nip width described above. The present embodiment sets the minimum value of contact pressure to 30 N. As described, the contact pressure is set to 30 N or greater and 300 N or smaller according to the present embodiment.

Electrophoresis of Toner

Figure 4:
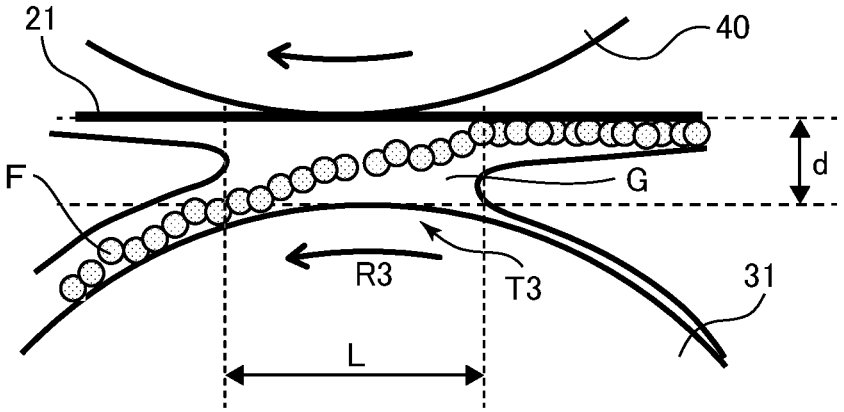
FIG. 4 is an explanatory view illustrating electrophoresis of toner.

Next, electrophoresis of toner at the nip portion T3 will be described with reference to FIG. 4. FIG. 4 is a view illustrating a modeled view of electrophoresis of toner, and in the drawing, the intermediate transfer belt 21 is illustrated linearly for easier understanding.

As described, the belt cleaning device 30 electrically removes toner F on the intermediate transfer belt 21 by the operation of an electric field, which is so-called electrophoresis. During the operation, a nip length L of the nip portion T3 must be ensured to more reliably move the toner F from the intermediate transfer belt 21 to the cleaning roller 31 by electrophoresis, and the nip length L (m) is a length that satisfies the following Expression 1.

$$(\mu \times E) \times (L/P) > d \qquad \text{Expression 1}$$

In Expression 1, $\mu(m^2/(V \times s))$ represents toner mobility, E (V/m) represents intensity of electric field that is generated at the nip portion T3 by application of voltage to the cleaning roller 31, P (m/s) represents rotational speed of the intermediate transfer belt 21, and d (μm) represents liquid thickness of liquid developer G at the nip portion T3. The nip length L refers to a length of toner remaining on the intermediate transfer belt 21 after secondary transfer by electrophoresis in a case where a so-called solid image where a solid toner image is formed on the whole surface of the recording material is secondarily transferred as toner image.

The left side of Expression 1 is a product of moving velocity of toner represented by (μ×E) and transit time for passing through the nip portion T3 represented by (L/P), in other words, the distance that toner can move by electrophoresis from the intermediate transfer belt 21 toward the cleaning roller 31. Meanwhile, the right side of Expression 1 is, as described above, the liquid thickness of liquid developer at the nip portion T3. In other words, if the nip length L according to which the left side of Expression 1 becomes greater than the right side is ensured, toner can move from the intermediate transfer belt 21 to the cleaning roller 31 via the liquid thickness of liquid developer while passing through the nip portion T3. As an example, toner mobility is $1.00^{-10}$ to $1.00^{-11}$ $(m^2/(V \times s))$. The electric field is 90 (V/μm). The rotational speed of the intermediate transfer belt 21 is 600 (mm/s). The liquid thickness d of liquid developer at the nip portion T3 is 2 (μm). In this case, the nip length L should be 1.5 (mm) or more. However, if the nip length L is elongated, a winding angle of the intermediate transfer belt 21 to the cleaning roller 31 is increased. This is not preferable from the viewpoint of belt life since the intermediate transfer belt 21 is repeatedly bent while rotating. Based on this viewpoint, the winding angle of the intermediate transfer belt 21 with respect to the cleaning roller 31 should preferably be less than 90°. More preferably, it should be less than 45°, or even more preferably less than 20°.

Now, the measurement of toner mobility, electric field, nip length and liquid thickness of liquid developer in Expression 1 will be described. The toner mobility μ may be expressed by following Expression 2.

$$\mu = |v/E| = Q/(6\pi \times \eta \times \alpha) \qquad \text{Expression 2}$$

In Expression 2, v (m/s) represents moving velocity of toner, and E (V/m) represents intensity of electric field that is generated at the nip portion T3 by application of voltage to the cleaning roller 31. Further, Q (C) represents amount of electric charge of the toner in the liquid developer, $\pi$ represents circular constant, $\eta$ represents viscosity of liquid developer (Pa·s), and $\alpha$ (μm) represents toner diameter. As an example, the viscosity of liquid developer is 4.0 (Pa·s), the toner diameter is 1.0 (μm) and the toner mobility can be calculated from these parameters. Further according to the present embodiment, the moving velocity of toner is approximately 9 to 90 (m/s). The amount of electric charge of toner can be calculated by the above-described various quantified parameters. Quantification of toner mobility is enabled by measurement using a measuring equipment such as a zeta potential measurement instrument Zeta-APS (product of Matec Applied Sciences Inc.).

The electric field is generally calculated by following Expression 3. In the expression, $\beta$ (V) represents voltage applied to the cleaning roller 31, and d (μm) represents liquid thickness of liquid developer at the nip portion T3.

$$E=\beta/d \qquad \text{Expression 3}$$

The electric field can be calculated by modeling a path from the cleaning roller 31 via resistors of liquid developer and the intermediate transfer belt 21 to the counter roller 40 as a series circuit and performing circuit calculation thereof. As an example, the voltage applied to the cleaning roller 31 is 1000 (V), the electric resistivity of liquid developer is 6.0E+6 (Ω·cm), and the liquid thickness of the liquid developer is 2 (μm). Further, the electric resistivity of the intermediate transfer belt 21 is 1.0E+10 (Ω·cm) and the thickness of the intermediate transfer belt 21 is 100 (μm). In this case, the electric field is calculated to be approximately 90 (V/μm).

The nip length can be confirmed by momentarily stopping power such as by cutting off power supply during image forming operation and measuring the length of the nip portion T3 in the stopped state. The nip length is determined by the diameters of the cleaning roller 31 and the counter roller 40 and the deformation amount of the intermediate transfer belt 21. In the present embodiment, the diameter of the cleaning roller 31 is 28 mm and the diameter of the counter roller 40 is 21 mm. The surface roughness of the cleaning roller 31 and the counter roller 40 is less than 0.2 μm in accordance with JIS B 0031:2003 Standard. The surface roughness of these rollers can be measured using PU-OS400 (product of Kosaka Laboratory Ltd.)

The liquid thickness of the liquid developer is obtained by scraping off a portion of liquid developer from the surface of the intermediate transfer belt 21 having passed through the nip portion T3 using a scraper and the like and actually measuring the height difference of an area where liquid developer had been scraped off and an area where liquid developer had not been scraped off using a confocal microscope and the like. A value having doubled the actually measured height difference is set as the liquid thickness of liquid developer. That is, the liquid developer at the nip portion T3 is separated by and moved away from each other along the intermediate transfer belt 21 and the cleaning roller 31 after passing the nip portion T3. Thereby, the liquid thickness of the liquid developer on the surface of the intermediate transfer belt 21 after passing the nip portion T3 becomes half the liquid thickness of the liquid developer at the nip portion T3. Therefore, liquid thickness of liquid developer at the nip portion T3 can be calculated by doubling the height difference being actually measured as above. A confocal microscope VK8700 (product of Keyence Corp.) may be used as the confocal microscope, for example.

Cleaning Nip Portion

As described, toner is moved via liquid developer from the intermediate transfer belt 21 to the cleaning roller 31 by electrophoresis according to the present embodiment, so that the nip portion T3 must be formed to satisfy the nip length L stated in Expression 1. Therefore, the cleaning roller 31 and the counter roller 40 are arranged so that the intermediate transfer belt 21 is wound around the cleaning roller 31 according to the present embodiment. This arrangement will be described with reference to FIG. 5.

Figure 5:
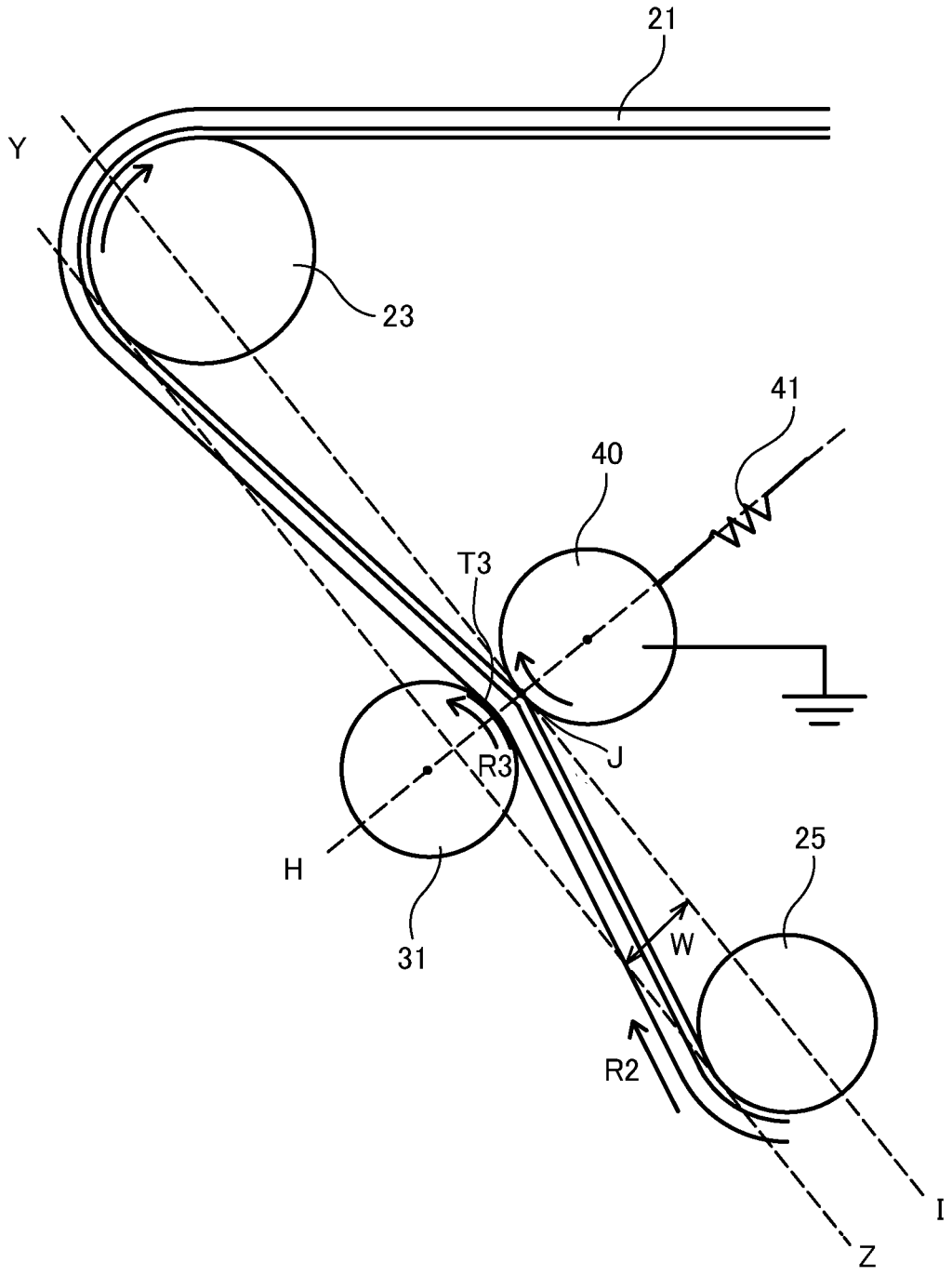
FIG. 5 is a schematic diagram illustrating an arrangement of a counter roller and a cleaning roller of the belt cleaning device according to the first embodiment.

As illustrated in FIG. 5, the cleaning roller 31 is arranged to push the intermediate transfer belt 21 from the outer side toward the inner side so that the intermediate transfer belt 21 is bent inward. Regarding the external common tangents of the secondary transfer inner roller 25 and the driving roller 23, the cleaning roller 31 is arranged so that the intermediate transfer belt 21 is projected inwardly of an external common tangent Z which is positioned at the side of the intermediate transfer belt, i.e., belt member. At least one of the driving roller 23 and the secondary transfer inner roller 25 is provided on a same side as the cleaning roller 31 with respect to a tangent I that passes an intersection J of the counter roller 40 and a straight line H connecting a center of rotation of the counter roller 40 and a center of rotation of the cleaning roller 31. In other words, at least one of the rollers is provided at a position entering an area Y at a side opposite from the counter roller 40 with respect to tangent I. That is, at least a partial area of one of the driving roller 23 and the secondary transfer inner roller 25 is provided on a same side as the cleaning roller 31 with respect to tangent I. In the illustrated example, both the driving roller 23 and the secondary transfer inner roller 25 are provided to enter area Y. In the present embodiment, the driving roller 23 serves as a first roller that initially tensions the intermediate transfer belt 21 on the downstream side of the cleaning roller 31 and the counter roller 40 in the direction of movement. Meanwhile, the secondary transfer inner roller 25 serves as a second roller that initially tensions the intermediate transfer belt 21 on the upstream side of the cleaning roller 31 and the counter roller 40 in the direction of movement. That is, the driving roller 23 serves as the first roller that is adjacent to the outer roller and the inner roller on a downstream side in a direction of movement of the belt member and is configured to tension the belt member. Also, the secondary transfer inner roller 25 serves as the second roller that is adjacent to the outer roller and the inner roller on an upstream side in the direction of movement of the belt member and configured to tension the belt member.

The cleaning roller 31 is fixed rotatably so as to press the intermediate transfer belt 21 from the outer side toward the inner side. Meanwhile, the counter roller 40 has bearings (not shown) that support both ends of the counter roller 40 which are urged by a pressurizing spring 41 so that the intermediate transfer belt 21 is pressed by the pressurizing spring 41 from the inner side toward the outer side. In the illustrated example, the cleaning roller 31 is fixed while the counter roller 40 is urged by the pressurizing spring 41, but any arrangement can be adopted as long as at least one of the cleaning roller 31 and the counter roller 40 is rotatably fixed and the other one of the rollers is urged by a spring.

The bending of the intermediate transfer belt 21 enables to increase the amount of winding of the intermediate transfer belt 21 around the cleaning roller 31 compared to a state where the intermediate transfer belt 21 is not bent. As described, the nip portion T3 includes the physical nip T3*b* and the tension nip T3*a* (refer to FIG. 2B), and the tension nip T3*a* is elongated as the amount of winding of the intermediate transfer belt 21 increases. By elongating the tension nip T3*a* in this manner, the nip length of the nip portion T3 can be set to a length that satisfies the above-described Expression 1, and thereby, the toner on the intermediate transfer belt 21 can be removed sufficiently by electrophoresis.

In the present embodiment, the relationship between the nip length L and electric field E required to realize electrophoresis of toner can be expressed by Expression 4, which is a variation of Expression 1.

$$E>(d\times P/\mu)/L \qquad \text{Expression 4}$$

Figure 6:
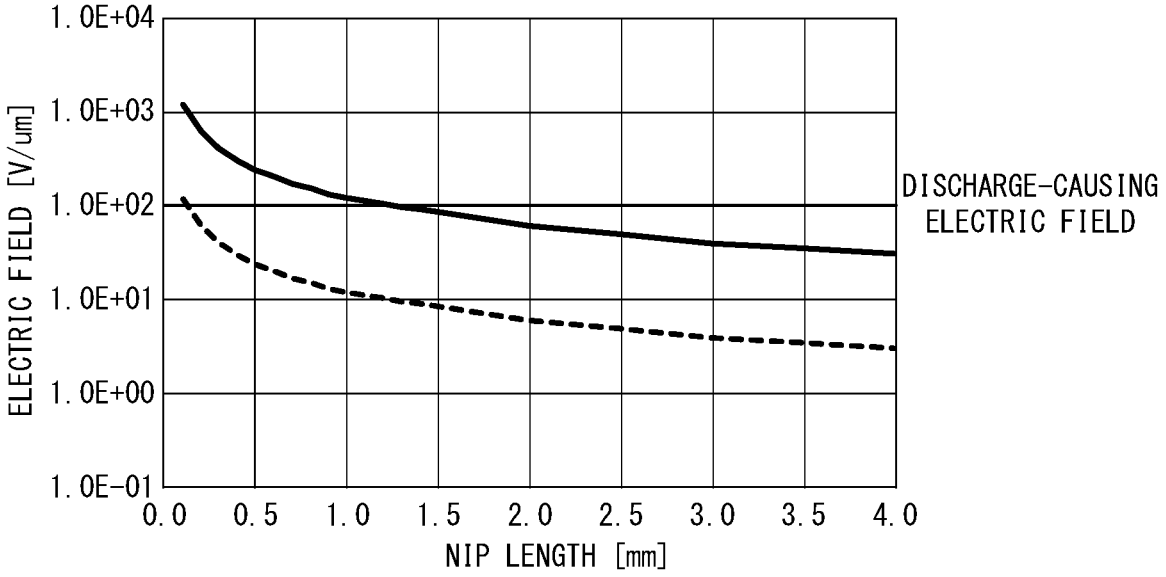
FIG. 6 is a graph illustrating a relationship between intensity of electric field and nip length.

The relationship between nip length and intensity of electric field, i.e., electric field intensity, is illustrated in FIG. 6. In FIG. 6, a case where the toner mobility is $1.00^{-11}$ ($m^2/(V\times s)$) is illustrated by a solid line, and a case where the toner mobility is $1.00^{-10}$ ($m^2/(V\times s)$) is illustrated by a dotted line. The graph shows a minimum electric field intensity required for each nip length. For example, in a case where the toner mobility is $1.00^{-10}$ ($m^2/(V\times s)$), if the nip length is 1.5 mm, toner will not move by electrophoresis unless an electric field intensity greater than approximately 1.0E+1 (V/μm) is obtained. Therefore, if an electric field equal to or greater than the electric field intensity indicated by each line is obtained, toner can move by electrophoresis at the nip portion T3. However, there is an upper limit in the electric field intensity. If the electric field intensity is too strong, discharge will occur near the nip portion T3 and the cleaning performance is deteriorated. In the present embodiment, discharge will occur if the electric field intensity is greater than 1.0E+2 (V/μm), so that the electric field intensity is set to 1.0E+2 (V/μm) or less.

In the present embodiment, the toner mobility may be set to $1.00^{-11}$ ($m^2/(V\times s)$). The toner mobility may drop by use, but if the toner mobility satisfies a minimum value, the cleaning performance by the belt cleaning device 30 can be ensured.

Next, a test was performed to compare cleaning performances between a case where the intermediate transfer belt 21 is bent by the cleaning roller 31 and the counter roller 40 formed of either a metal roller or a rubber roller and a case where the intermediate transfer belt 21 is not bent. The result of the test is shown in Table 1. The cleaning roller 31 used in the test had a diameter of 28 mm and the counter roller 40 used in the experiment had a diameter of 21 mm. The rubber roller had an elastic layer formed of urethane rubber with a thickness of 2 mm, and the Young's modulus thereof was 0.3 (MPa). First, second and fourth examples are comparative examples, and third and fifth examples correspond to the present embodiment.

TABLE 1

| Cleaning roller | Counter roller | Nip length [mm] | Projection amount of cleaning roller [min] | Electric field [V/μm] | Cleaning performance |
|---|---|---|---|---|---|
| Rubber | Rubber | 1.5 | 0 | 85 | GOOD |
| Metal | Rubber | 0.8 | 0 | 115 | POOR |
| | | 1.5 | 5 | 85 | GOOD |
| Metal | Metal | 0.3 | 0 | 300 | POOR |
| | | 1.5 | 7 | 85 | GOOD |

As a first example, in a case where the cleaning roller 31 and the counter roller 40 are both rubber rollers, and the amount of projection of the cleaning roller 31 is "0 mm", a nip portion T3 having a nip length of "1.5 mm" is formed. In this case, the amount of projection of the cleaning roller 31 is a distance between an external common tangent Z on the side of the intermediate transfer belt and an abutment position of the cleaning roller 31 and the intermediate transfer belt 21 which is the abutment position farthest from the external common tangent Z in the nip portion T3 (which is denoted by reference W in FIG. 5). That is, in a case where the intermediate transfer belt 21 is not bent, the amount of projection of the cleaning roller 31 is "0". In this case, a satisfactory cleaning performance is achieved by an electric field intensity of 85 (V/μm), as shown in Table 1.

As a second example, in a case where the cleaning roller 31 is a metal roller, the counter roller 40 is a rubber roller and the amount of projection of the cleaning roller 31 is "0", the nip portion T3 having a nip length of "0.8 mm" is formed. In this case, as illustrated in Table 1, a satisfactory cleaning performance could not be obtained even if the electric field intensity was increased (115 (V/μm)) from that in the first example. This is because the metal roller is not easily deformed compared to the rubber roller and only a nip length shorter than that in the first example can be obtained, so that a nip portion T3 long enough for forming a solution layer having sufficient liquid developer for moving the toner by electrophoresis cannot be ensured. Therefore, as a third example, a nip length of "1.5 mm" which is equivalent to the first embodiment is ensured by arranging the cleaning roller 31 to be projected by an amount of projection of "5 mm", that is, by bending the intermediate transfer belt 21. By ensuring a nip length of "1.5 mm", a satisfactory cleaning effect can be obtained by an electric field intensity of 85 (V/μm), as shown in Table 1.

As a fourth example, in a case where both the cleaning roller 31 and the counter roller 40 are metal rollers and the amount of projection of the cleaning roller 31 is "0", the nip portion T3 having a nip length of "0.3 mm" is formed. In this case, a satisfactory cleaning performance could not be obtained even if the electric field was increased significantly (300 (V/μm)) more than that in the first example, as illustrated in Table 1. This is because only a short nip length can be obtained between two metal rollers, and a nip portion T3 long enough for forming a solution layer having sufficient liquid developer for moving the toner by electrophoresis cannot be ensured. Further, the electric field intensity becomes too high and discharge may occur. Therefore, as a fifth example, the amount of projection of the cleaning roller 31 is set to "7 mm" which is greater than that of the third example. Thereby, a nip length of "1.5 mm" which is equivalent as the first example can be ensured, and a satisfactory cleaning performance can be obtained by an electric field intensity of 85 (V/μm), as shown in Table 1.

As described, according to the present embodiment, the intermediate transfer belt 21 is pressed inward from the outer side by the cleaning roller 31 so as to ensure the nip portion T3 long enough for forming a solution layer of liquid developer sufficient for moving toner by electrophoresis. Thereby, the amount of winding of the intermediate transfer belt 21 around the cleaning roller 31 is increased, and the tension nip T3*a* can be elongated. The tension nip T3*a* can be elongated to ensure the nip portion T3 having a nip length long enough to move the toner on the intermediate transfer belt 21 sufficiently by electrophoresis (refer to Expression 1). As described, the present embodiment enables to ensure a nip portion T3 enough to allow toner on the intermediate transfer belt 21 to be moved sufficiently by electrophoresis. Thereby, enhancement of durability of the cleaning roller 31 and improvement of cleaning performance can both be realized.

Second Embodiment

Figure 7A:
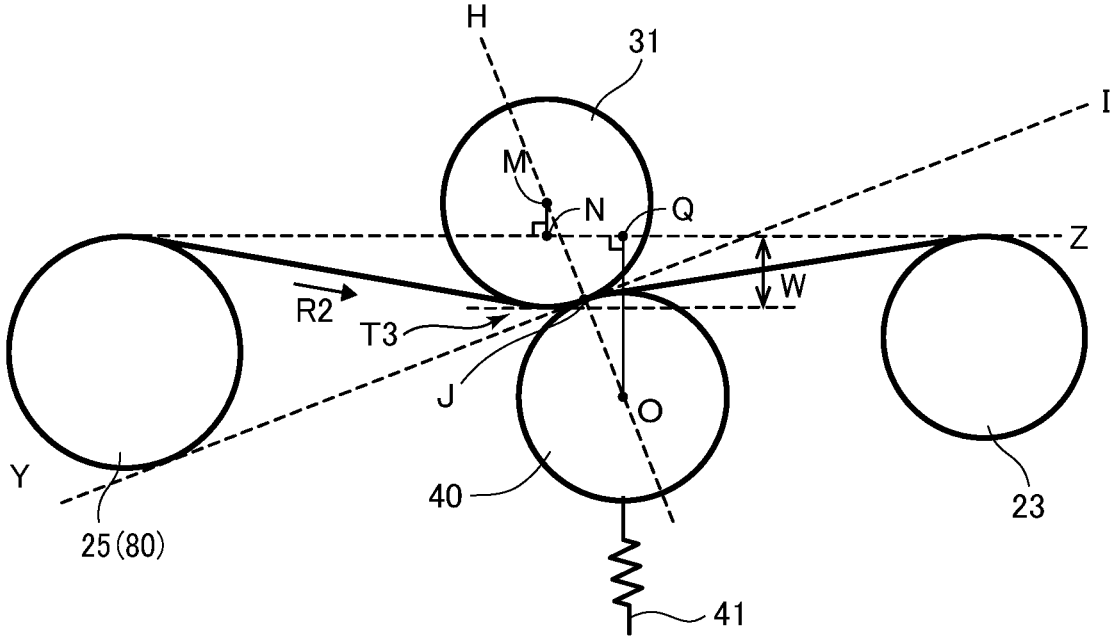
FIG. 7A is a schematic diagram illustrating an arrangement of a counter roller and a cleaning roller of a belt cleaning device according to a second embodiment.
Figure 7B:
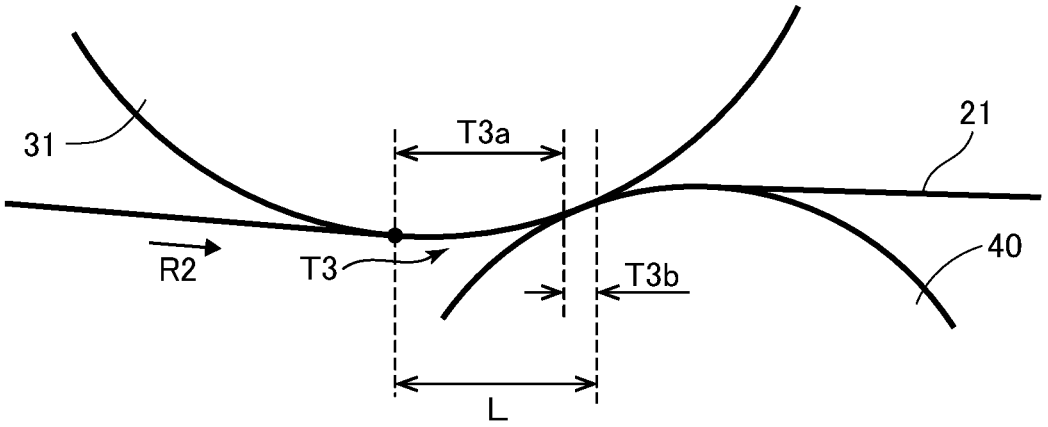
FIG. 7B is an enlarged view illustrating a nip portion of the belt cleaning device illustrated in FIG. 7A.
Figure 8:
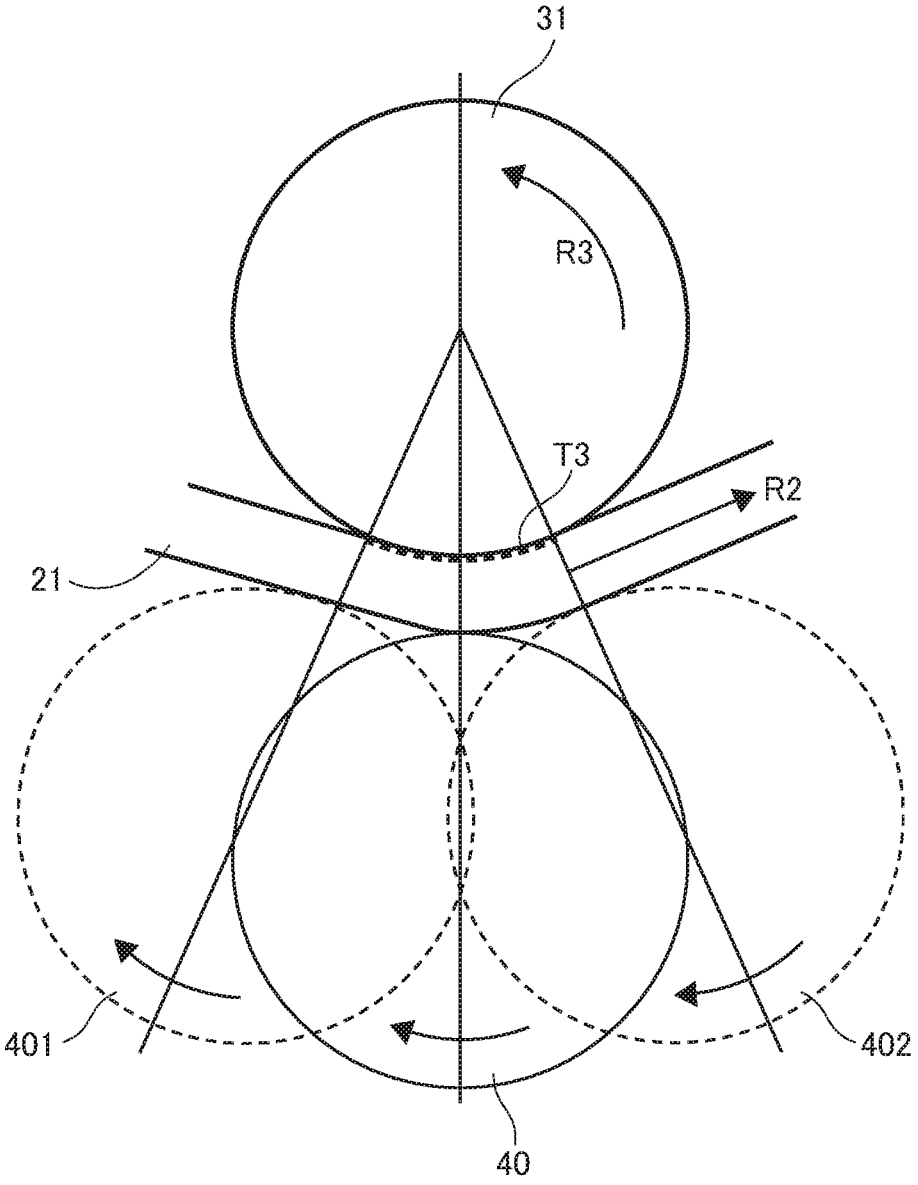
FIG. 8 is a schematic diagram illustrating an offset arrangement of counter roller and cleaning roller.

A second embodiment will be described with reference to FIGS. 7A to 8. The second embodiment illustrated here attempts to form a nip portion T3 having a longer nip length than the first embodiment by arranging the cleaning roller 31 and the counter roller 40 in an offset manner, different from the first embodiment. Hereafter, similar components as the first embodiment are denoted with the same reference numbers to simplify or omit descriptions and illustrations, and the differences from the first embodiment are mainly described. FIG. 7A is a view illustrating a concept of the embodiment of the present disclosure, wherein a secondary transfer inner roller 25 or an idler roller 80 (refer to FIG. 10) described later serve as a second roller.

As illustrated in FIG. 7A, according to the present embodiment, regarding the external common tangents Z of the secondary transfer inner roller 25 and the driving roller 23, the cleaning roller 31 is arranged so that the intermediate transfer belt 21 is projected inwardly of the external common tangent Z which is positioned on the side of the intermediate transfer belt, similar to the first embodiment. At least one of the driving roller 23 and the secondary transfer inner roller 25 is provided at a position entering an area Y opposite from the counter roller 40 with respect to a tangent I that passes an intersection J of the counter roller 40 and a straight line H connecting a center of rotation of the counter roller 40 and a center of rotation of the cleaning roller 31. In the illustrated example, the secondary transfer inner roller 25 is provided at a position entering area Y That is, at least a portion of one of the rollers of the driving roller 23 and the secondary transfer inner roller 25 is provided on a same side as the cleaning roller 31 with respect to tangent I.

Unlike the first embodiment, the cleaning roller 31 and the counter roller 40 are arranged in an offset manner. That is, the cleaning roller 31 is arranged so that a first intersection N of the external common tangent Z and a perpendicular line passing a center of rotation M of the cleaning roller 31 is deviated in the direction of movement from a second intersection Q of the external common tangent Z and a perpendicular line passing a center of rotation O of the counter roller 40. However, according to the present embodiment, a center position in the direction of movement of the physical nip T3*b* is arranged downstream of the center position in the direction of movement of the nip portion T3 (refer to FIG. 7B). The cleaning roller 31 presses the intermediate transfer belt 21 from an outer side toward the inner side, and the counter roller 40 presses the intermediate transfer belt 21 from the inner side toward the outer side by the pressurizing spring 41. The cleaning roller 31 and the counter roller 40 are offset within an area where the physical nip T3*b* is formed. Discharge can be suppressed by forming the physical nip T3*b*.

The nip portion T3 having a nip length that satisfies Expression 1 described above can be formed by arranging the cleaning roller 31 and the counter roller 40 in an offset manner, without having to increase the amount of projection of the cleaning roller 31 compared to the first embodiment described earlier. That is, as illustrated in FIG. 7B, by adopting an offset arrangement, the amount of winding of the intermediate transfer belt 21 around the cleaning roller 31 can be increased, and the tension nip T3*a* can be elongated. By elongating the tension nip T3*a* and ensuring the nip portion T3 to have a nip length satisfying Expression 1, toner on the intermediate transfer belt 21 can be removed sufficiently by electrophoresis. The second embodiment described above is especially effective in a case where the cleaning roller 31 and the counter roller 40 are both metal rollers.

According to the present embodiment, the cleaning roller 31 should preferably be arranged to abut against the intermediate transfer belt 21 upstream of the counter roller 40 in the direction of movement of the intermediate transfer belt 21, as illustrated in FIGS. 7A and 7B. That is, the cleaning roller 31 should preferably be arranged so that the first intersection N is positioned upstream of the second intersection Q in the direction of movement of the intermediate transfer belt 21 with respect to the counter roller 40. This arrangement is preferable for suppressing deterioration of cleaning performance caused by generation of discharge.

The above-described discharge will be described based on FIG. 8 with reference to FIG. 7B. FIG. 8 also illustrates a case where the cleaning roller 31 is not offset with respect to the counter roller 40 (refer to FIG. 5). As described above, according to the present embodiment, the cleaning roller 31 and the counter roller 40 are arranged in an offset manner to elongate the tension nip T3*a*. Then, the path of current flowing from the cleaning roller 31 to the intermediate transfer belt 21 is widened, but the path for the current is narrowed depending on the position of the counter roller 40. Discharge easily occurs if the cleaning roller 31 is arranged in an offset manner downstream of a counter roller 401 in the direction of movement, as illustrated in FIG. 8. In this case, current from the intermediate transfer belt 21 concentrates toward the counter roller 401 in a state where charge injection from the cleaning roller 31 to the intermediate transfer belt 21 is small. Especially at the physical nip T3*b* on an upstream side in the direction of movement of the intermediate transfer belt 21, potential difference between the surface of the cleaning roller 31 and the surface of the intermediate transfer belt 21 is increased and discharge occurs at the upstream side in the direction of movement. In this case, a large amount of toner still remains on the cleaning roller 31 at the upstream side in the direction of movement, so that impact of discharge on the cleaning performance is great.

Meanwhile, discharge will not easily occur at the upstream side in the direction of movement if the cleaning roller 31 is arranged in an offset manner on the upstream side of a counter roller 402 in the direction of movement. In this case, current from the intermediate transfer belt 21 toward the counter roller 402 concentrates at the physical nip T3*b* after charge injection from the cleaning roller 31 to the intermediate transfer belt 21 occurs at the tension nip T3*a*. Then, the potential difference between the surface of the cleaning roller 31 and the surface of the intermediate transfer belt 21 will not be increased at the upstream side in the direction of movement of the intermediate transfer belt 21, and discharge will not occur easily. Further according to this case, even if discharge occurs at the physical nip T3*b* on the downstream side in the direction of movement of the intermediate transfer belt 21, a large portion of toner has already moved to the cleaning roller 31, so that there is very little impact on the cleaning performance.

Table 2 shows the result of having compared the cleaning performances of cases where the cleaning roller 31 and the counter roller 40 are offset upstream in the direction of movement and offset downstream in the direction of movement. Further, the cleaning performance of a case where the cleaning roller 31 is not offset with respect to the counter roller 40 is also shown for reference (center of Table 2).

TABLE 2

| Position of cleaning roller | Nip length [mm] | Presence or absence of discharge on upstream side | Cleaning residue concentration |
|---|---|---|---|
| Downstream side | 1.5 | Present | 0.008 |
| Middle | 1.5 | Absent | 0.003 |
| Upstream side | 1.5 | Absent | 0.003 |

As can be recognized from Table 2, if the cleaning roller 31 and the counter roller 40 are arranged in an offset manner, the cleaning performance is more preferable when the cleaning roller 31 is arranged in an offset position upstream of the counter roller 402 in the direction of movement. In contrast, when the cleaning roller 31 is arranged in an offset position downstream of the counter roller 402 in the direction of movement, discharge occurs upstream in the direction of movement as described earlier, and some remaining toner occurs. The density of remaining toner is measured by a densitometer manufactured by X-Rite, Inc., and the result was approximately 0.008. This shows that the cleaning performance has been deteriorated compared to a case where the density of the remaining toner is approximately 0.003 or less with the cleaning roller 31 arranged in an offset position upstream of the counter roller 402 in the direction of movement.

As described, according to the second embodiment, the nip portion T3 sufficient for moving the toner on the intermediate transfer belt 21 by electrophoresis can be easily ensured by arranging the cleaning roller 31 and the counter roller 40 in an offset manner. Specifically, a preferable cleaning performance can be realized by arranging the cleaning roller 31 in an offset position upstream of the counter roller 402 in the direction of movement (refer to FIG. 8). Thus, an effect similar to the first embodiment of realizing both the enhancement of durability and improvement of cleaning performance of the cleaning roller 31 can be realized according to the second embodiment.

Third Embodiment

Figure 9:
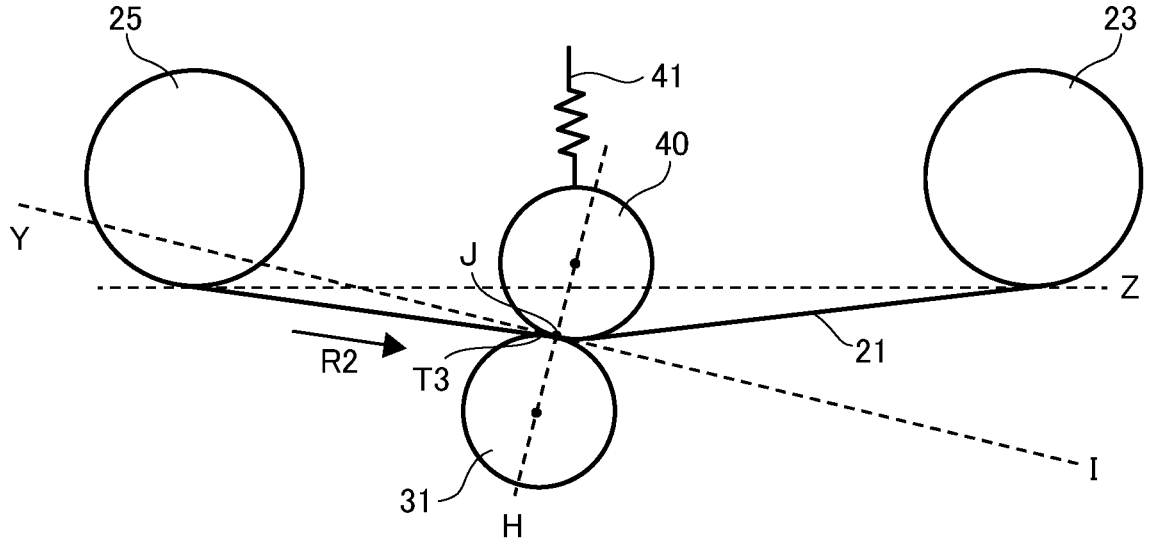
FIG. 9 is a schematic diagram illustrating an arrangement of a counter roller and a cleaning roller of a belt cleaning device according to a third embodiment.

The first and second embodiments described above have illustrated an example of bending the intermediate transfer belt 21 by pressing the intermediate transfer belt 21 from the outer side toward the inner side by the cleaning roller 31, but the present disclosure is not limited to this example. For example, the intermediate transfer belt 21 can be bent by pressing the intermediate transfer belt 21 from the inner side toward the outer side by the counter roller 40. A third embodiment will be described with reference to FIG. 9. According to the present embodiment, similar components as the first embodiment are denoted with the same reference numbers to simplify or omit descriptions and illustrations, and the differences from the first embodiment are mainly described. FIG. 9 is a view illustrating a concept of the embodiment of the present disclosure, wherein the secondary transfer inner roller 25 or an idler roller 80 (refer to FIG. 10) serves as a second roller.

As illustrated in FIG. 9, according to the present embodiment, the counter roller 40 presses the intermediate transfer belt 21 from the inner side toward the outer side so that the intermediate transfer belt 21 is bent outward. Specifically, regarding the external common tangents of the secondary transfer inner roller 25 and the driving roller 23, the counter roller 40 is arranged so as to project the intermediate transfer belt 21 outward of the external common tangent Z positioned on the side of the intermediate transfer belt. At least one of the driving roller 23 and the secondary transfer inner roller 25 is provided at a position entering an area Y that is opposite from the counter roller 40 with respect to a tangent I that passes an intersection J of the counter roller 40 and a straight line H connecting a center of rotation of the counter roller 40 and a center of rotation of the cleaning roller 31. In the illustrated example, the secondary transfer inner roller 25 is provided at a position entering area Y. At least a part of either one of the driving roller 23 and the secondary transfer inner roller 25 is provided on a same side as the cleaning roller 31 with respect to the tangent I.

The counter roller 40 presses the intermediate transfer belt 21 from the inner side toward the outer side by the pressurizing spring 41. Meanwhile, the cleaning roller 31 is rotatably fixed so as to press the intermediate transfer belt 21 from the outer side toward the inner side.

In the present embodiment, the amount of winding of the intermediate transfer belt 21 around the cleaning roller 31 is not increased by simply bending the intermediate transfer belt 21 outward. If the amount of winding of the intermediate transfer belt 21 is not increased, the tension nip T3*a* cannot be elongated, and the nip length of the nip portion T3 cannot be set to a length satisfying the above Expression 1. Therefore, according to the present embodiment, the cleaning roller 31 and the counter roller 40 must be arranged in an offset manner in a state where the physical nip T3*b* is formed. By arranging the cleaning roller 31 and the counter roller 40 in an offset manner, it becomes possible to ensure the nip portion T3 capable of enabling toner on the intermediate transfer belt 21 to be moved sufficiently by electrophoresis. Even according to this case, similar to the second embodiment described above (refer to FIG. 8), a more preferable cleaning performance can be obtained by arranging the cleaning roller 31 in an offset position upstream of the counter roller 402 in the direction of movement compared to a case where the cleaning roller 31 is arranged in an offset position downstream of the counter roller 402 in the direction of movement.

As described, even according to the third embodiment, the nip portion T3 capable of sufficiently moving the toner on the intermediate transfer belt 21 by electrophoresis can be ensured easily. Thereby, both enhancement of durability and improvement of cleaning performance of the cleaning roller 31 can be realized.

Fourth Embodiment

Figure 10:
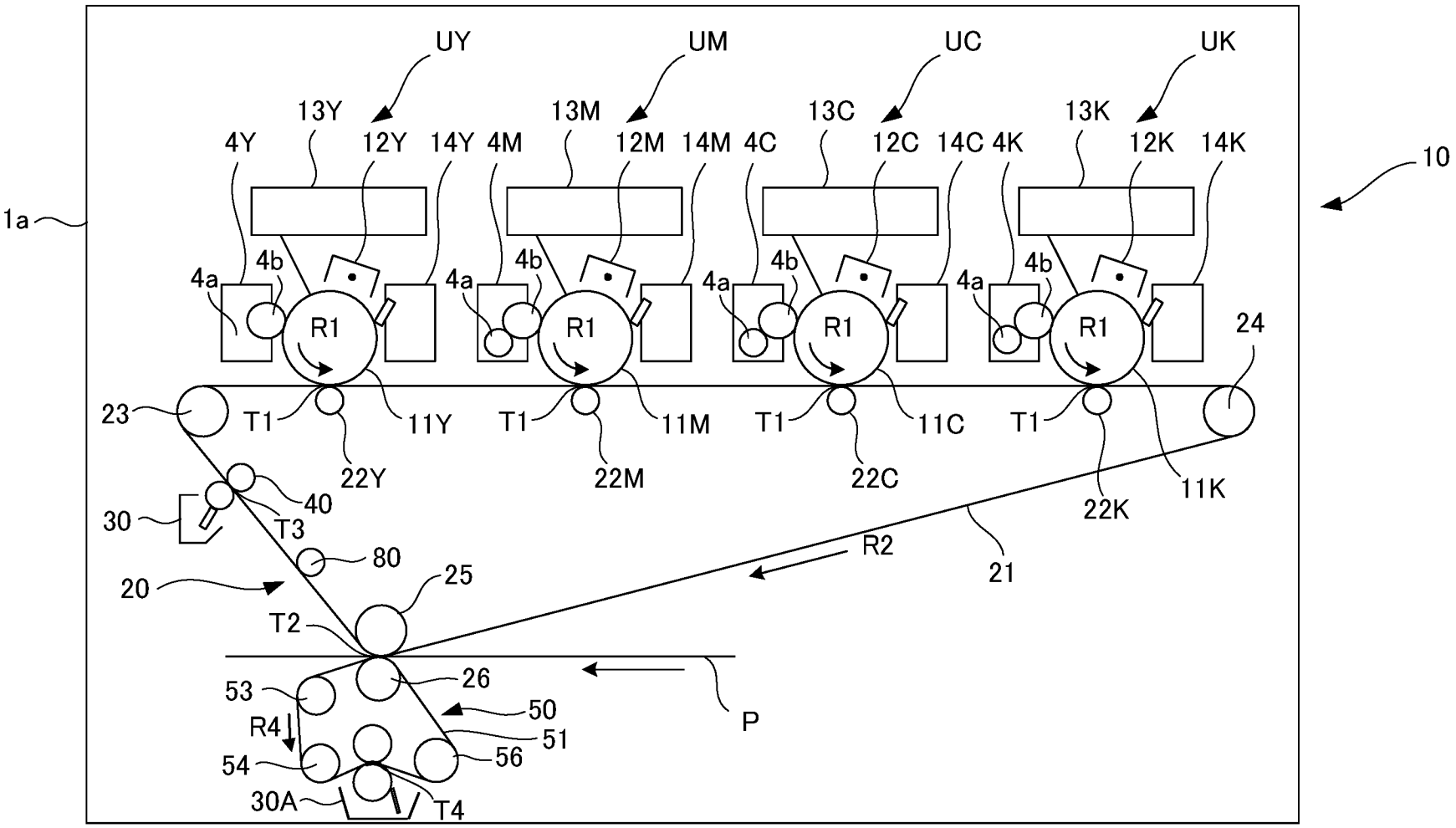
FIG. 10 is a schematic drawing illustrating a configuration of an image forming apparatus including an idler roller and a secondary transfer unit according to a fourth embodiment.

There may be a case where the intermediate transfer belt 21 is wound around and supported by an idler roller in addition to the driving roller 23, the tension roller 24 and the secondary transfer inner roller 25. An idler roller may be arranged downstream of the secondary transfer inner roller 25 and upstream of a cleaning tip portion T3 with respect to the direction of movement of the intermediate transfer belt 21 to tension the intermediate transfer belt 21. In this case, the idler roller will affect the nip length of the nip portion T3 instead of the secondary transfer inner roller 25 described above. The image forming apparatus equipped which such an idler roller is illustrated in FIG. 10. The belt cleaning device 30 described above is applicable to such image forming apparatus. This embodiment will be described hereafter. The configurations similar to the embodiments described earlier are denoted with the same reference numbers, and descriptions and illustrations thereof are either omitted or simplified.

As illustrated in FIG. 10, the intermediate transfer unit 20 includes the endless intermediate transfer belt 21 serving as a belt member, the primary transfer rollers 22Y to 22K, the driving roller 23, the tension roller 24, the secondary transfer inner roller 25 and the idler roller 80. The intermediate transfer belt 21 is wound around and supported by the driving roller 23, the tension roller 24, the secondary transfer inner roller 25 and the idler roller 80 and driven to rotate by the driving roller 23 in a direction of arrow R2 in FIG. 10. In the present embodiment, the idler roller 80 is fixed rotatably on an inner circumferential side of the intermediate transfer belt 21 and tensions the intermediate transfer belt 21. Meanwhile, the driving roller 23 is fixed rotatably on an inner circumference side of the intermediate transfer belt 21 and tensions the intermediate transfer belt 21 at a position downstream of the secondary transfer inner roller 25 in the direction of movement of the intermediate transfer belt 21.

Cleaning Nip Portion

Figure 2B:
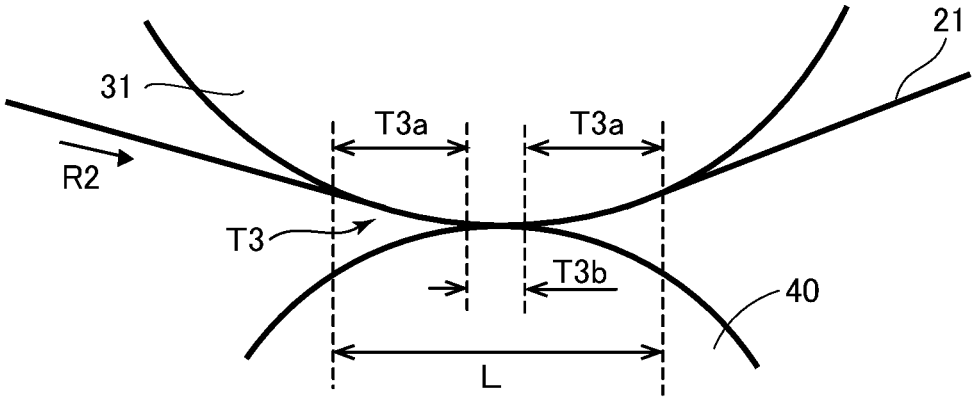
FIG. 2B is an enlarged view illustrating a nip portion of the belt cleaning device illustrated in FIG. 2A.

Also according to the present embodiment, similar to the embodiments described earlier, the nip portion T3 having the nip length L that satisfies Expression 1 described above must be formed to move toner from the intermediate transfer belt 21 to the cleaning roller 31 via liquid developer by electrophoresis (refer to FIG. 2B). Therefore, according to the present embodiment, the cleaning roller 31 is arranged at a position capable of having the intermediate transfer belt 21 wound around the cleaning roller 31. The arrangement will be described with reference to FIG. 11.

Figure 11:
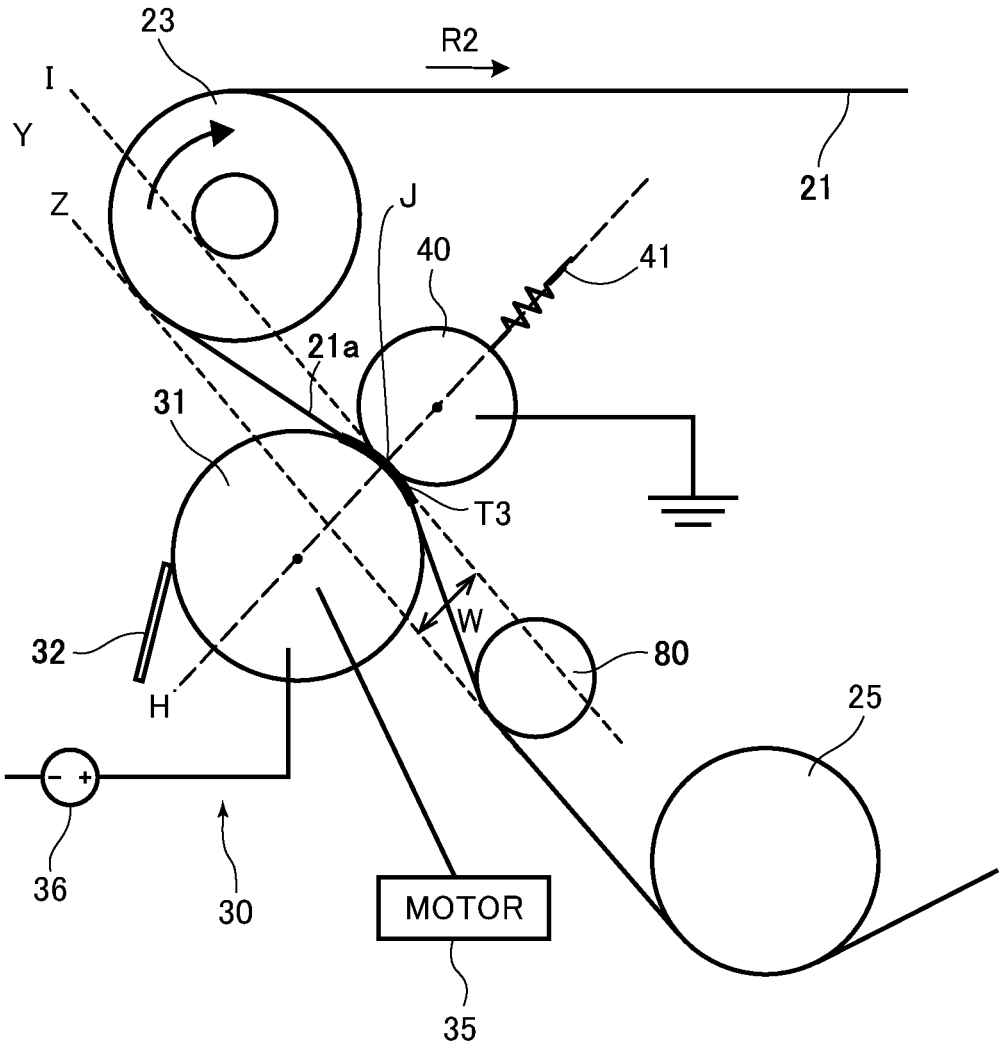
FIG. 11 is an explanatory view of the idler roller and the belt cleaning device.

As illustrated in FIG. 11, the cleaning roller 31 presses a tension portion 21*a* of the intermediate transfer belt 21 tensioned by the idler roller 80 and the driving roller 23 from the outer circumferential side toward the inner circumferential side. The cleaning roller 31 is fixed rotatably on an outer circumferential side of the intermediate transfer belt 21 so as not to displace the intermediate transfer belt 21 with respect to the idler roller 80 and the driving roller 23 tensioning the belt 21. In the present embodiment, regarding the external common tangents of the idler roller 80 and the driving roller 23, the positional relationship of the three rollers is determined so that the intermediate transfer belt 21 is projected inwardly of the external common tangent Z which is positioned on the side of the intermediate transfer belt, i.e., belt member. At least one of the driving roller 23 and the secondary transfer inner roller 25 is provided on a same side as the cleaning roller 31 with respect to a tangent I that passes an intersection J of the counter roller 40 and a straight line H connecting a center of rotation of the counter roller 40 and a center of rotation of the cleaning roller 31. In other words, at least a portion of one of the driving roller 23 and the idler roller 80 is provided on a same side as the cleaning roller 31 with respect to tangent I. In other words, it is provided at a position entering an area Y on a side opposite from the counter roller 40 of tangent I. In the illustrated example, both the driving roller 23 and the idler roller 80 are provided to enter the area Y In the present embodiment, the driving roller 23 serves as a first roller that initially tensions the intermediate transfer belt 21 on the downstream side of the cleaning roller 31 and the counter roller 40 in the direction of movement. Meanwhile, the idler roller 80 serves as a second roller that initially tensions the intermediate transfer belt 21 on the upstream side of the cleaning roller 31 and the counter roller 40 in the direction of movement. The secondary transfer inner roller 25 is a third roller that tensions the intermediate transfer belt 21 upstream of the idler roller 80 in the direction of movement. The driving roller 23 and the idler roller 80 are fixed so as not to move from the arranged positions. The counter roller 40 is not fixed and urged by a spring, that is, movable, so as to press the intermediate transfer belt 21 from the inner side toward the outer side by the pressurizing spring 41.

The intermediate transfer belt 21 is pressed by the cleaning roller 31 with a predetermined contact pressure. If the contact pressure is too high, not only the deterioration of the intermediate transfer belt 21 mentioned earlier is hastened but also the driving load of the driving roller 23 may increase and wear of the bearing that supports each roller may be hastened by the increase of load to each roller tensioning the intermediate transfer belt 21. On the other hand, if the contact pressure is too small, the cleaning roller 31 may fluctuate while the intermediate transfer belt 21 is driven, and amount of winding of the intermediate transfer belt 21 around the cleaning roller 31 may be varied. That is, the size, i.e., contact area, of the nip portion may fluctuate during driving of the belt. Therefore, according to the present embodiment, the positional relationship of the three rollers is determined so that the contact pressure between the intermediate transfer belt 21 and the cleaning roller 31 is set to 30 N or greater and 300 N or smaller, as described earlier, and each roller is fixed to position. The adjustment of contact pressure between the intermediate transfer belt 21 and the cleaning roller 31 can be realized by the tension roller 24 (refer to FIG. 10) in addition to the positional relationship of the three rollers mentioned above.

Since the intermediate transfer belt 21 is bent inward by three rollers, which are the cleaning roller 31, the idler roller 80 and the driving roller 23 according to the present embodiment, the contact pressure is stabilized, and the size of the nip portion T3 will not be varied while driving the belt. In other words, by fixing the three rollers, the intermediate transfer belt 21 will not return to a linear state even if force acts on the intermediate transfer belt 21 to return the belt from the approximately U-shaped bent shape to a linear shape while the intermediate transfer belt 21 is driven, so that the size of the nip portion T3 is not easily varied. For example, fluctuation or deviation of the intermediate transfer belt 21 caused by the recording material P entering the secondary transfer portion T2 is suppressed by the three rollers mentioned above, and the size of the nip portion T3 will not be easily varied. The fluctuation of the intermediate transfer belt 21 is further suppressed by the tension roller 24 according to the present embodiment, so that the variation of size of the nip portion T3 is even further suppressed by cooperation of the three rollers and the tension roller 24.

In a state where the intermediate transfer belt 21 is bent, the amount of winding of the intermediate transfer belt 21 with respect to the cleaning roller 31 is increased compared to a case where the intermediate transfer belt 21 is not bent. As described above, the nip portion T3 includes the physical nip T3*b* and the tension nip T3*a* (refer to FIG. 2B), and the tension nip T3*a* elongates as the amount of winding of the intermediate transfer belt 21 increases. By elongating the tension nip T3*a*, the nip length of the nip portion T3 can be set to a length capable of satisfying Expression 1, so that toner on the intermediate transfer belt 21 can be sufficiently removed by electrophoresis.

The present embodiment presses the intermediate transfer belt 21 from the outer side toward the inner side by the cleaning roller 31 so as to bend the intermediate transfer belt 21 and ensure the nip portion T3 capable of forming a solution layer of liquid developer sufficient to move the toner by electrophoresis. Thereby, the amount of winding of the intermediate transfer belt 21 with respect to the cleaning roller 31 is increased, and the tension nip T3*a* can be elongated. The tension nip T3*a* can be elongated so that the nip length of the nip portion T3 has sufficient length to move the toner on the intermediate transfer belt 21 by electrophoresis (refer to Expression 1). Further, the cleaning roller 31 is fixed to an outer circumferential side of the intermediate transfer belt 21 so that the intermediate transfer belt 21 is not displaced with respect to the idler roller 80 and the driving roller 23 which tensions the belt. Since the intermediate transfer belt 21 is bent by these three fixed rollers, the size, i.e., contact area, of the nip portion T3 is not easily varied while driving the belt. As described, according to the present embodiment, the nip portion T3 enough to move the toner on the intermediate transfer belt 21 by electrophoresis and suppressing variation of the contact area while driving the belt can be ensured easily.

According to the present embodiment, as illustrated in FIG. 7A described above, the cleaning roller 31 and the counter roller 40 may be positioned in an offset manner. In that case, the secondary transfer inner roller 25 illustrated in FIG. 7A corresponds to the idler roller 80. That is, regarding the external common tangents of the driving roller 23 and the idler roller 80, the cleaning roller 31 causes the intermediate transfer belt 21 to project inwardly of the external common tangent Z on the side of the intermediate transfer belt. At least one of the driving roller 23 and the idler roller 80 is provided in area Y on a same side as the cleaning roller 31 with respect to a tangent I that passes an intersection J of the counter roller 40 and a straight line H connecting a center of rotation of the counter roller 40 and a center of rotation of the cleaning roller 31. In the illustrated example, the idler roller 80 is provided on the same side as the cleaning roller 31. Thereby, the nip portion T3 enough to move the toner on the intermediate transfer belt 21 by electrophoresis can be ensured easily.

The belt cleaning device 30 described above is applicable to a secondary transfer belt cleaning device for cleaning an endless secondary transfer belt serving as a belt member. This example will be described below. In the following description, configurations similar to the respective embodiments described earlier are denoted with the same reference numbers, and descriptions thereof are omitted or simplified.

Secondary Transfer Unit

As illustrated in FIG. 10, an image forming apparatus equipped with a secondary transfer unit 50 to perform secondary transfer of the toner image transferred to the intermediate transfer belt 21 to a recording material P is proposed. In the present embodiment, the recording material P is conveyed to the secondary transfer portion T2 by the secondary transfer unit 50. The secondary transfer unit 50 includes a secondary transfer belt 51, the secondary transfer outer roller 26, a separation roller 53, an idler roller 54, a belt driving roller 56 and a secondary transfer cleaning device 30A. The secondary transfer unit 50 performs secondary transfer of toner image in a state where the recording material P borne on the secondary transfer belt 51 passes the secondary transfer portion T2.

The secondary transfer belt 51 is an endless belt tensioned by the secondary transfer outer roller 26, the separation roller 53, the idler roller 54 and the belt driving roller 56. The secondary transfer belt 51 is rotated in the direction of arrow R4 in the drawing by the belt driving roller 56 in synchronization with the intermediate transfer belt 21, conveying the recording material P through the secondary transfer portion T2 to a fixing unit knot shown). The belt driving roller 56 tensions the secondary transfer belt 51 downstream of the idler roller 54 in the direction of movement of the secondary transfer belt 51. A resin belt is adopted as the secondary transfer belt 51. Specifically, the resin belt is formed of polyimide.

The secondary transfer outer roller 26 is in pressure contact with the secondary transfer inner roller 25 via the intermediate transfer belt 21 and the secondary transfer belt 51, and forms the secondary transfer portion T2 between the intermediate transfer belt 21 and the secondary transfer belt 51. A secondary transfer voltage having opposite polarity as that of the toner is applied to the secondary transfer outer roller 26 from a high voltage power supply knot shown), and a transfer electric field is generated at the secondary transfer portion T2 in accordance therewith. In response to this transfer electric field, yellow, magenta, cyan and black toner images borne on the intermediate transfer belt 21 are collectively secondarily transferred to the recording material P.

The separation roller 53 separates the recording material P from the secondary transfer belt 51 at a position downstream of the secondary transfer portion T2 in the direction of movement of the secondary transfer belt 51. Specifically, after reaching the separation roller 53, the recording material P on the secondary transfer belt 51 is self-stripped from the secondary transfer belt 51 on a curved surface of the secondary transfer belt 51 curved along the circumferential surface of the separation roller 53. According to the present embodiment, the separation roller 53 applies predetermined tension to the secondary transfer belt 51 by urging the secondary transfer belt 51 from the inner side toward the outer side by urging force of a pressure spring knot shown). In other words, the separation roller 53 also serves as a tension roller.

The recording material P self-stripped from the secondary transfer belt 51 is conveyed to a fixing unit (not shown), and the toner image is fixed to the recording material P at the fixing unit. The recording material P to which the toner image has been fixed is discharged to the exterior of the apparatus body. After the passing of the recording material P through the secondary transfer portion T2, toner on the secondary transfer belt 51 is removed by the secondary transfer cleaning device 30A. The secondary transfer cleaning device 30A will be described in detail later with reference to FIGS. 12 to 15.

Fifth Embodiment

Figure 12:
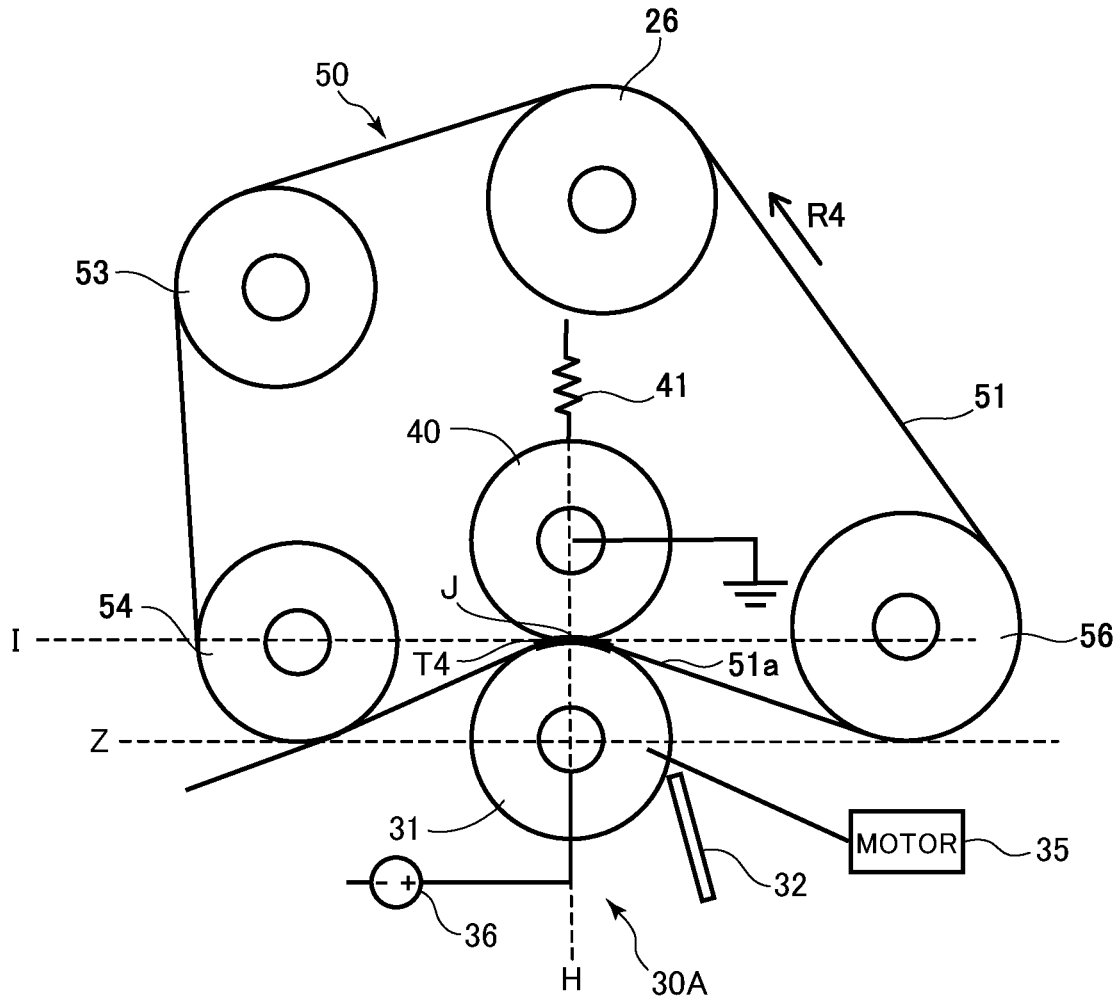
FIG. 12 is a schematic drawing illustrating a secondary transfer unit according to a fifth embodiment.

A fifth embodiment will now be described with reference to FIG. 12. As illustrated in FIG. 12, in the case of the secondary transfer unit 50 of the present embodiment, the counter roller 40 and the cleaning roller 31 are respectively abutted against the inner circumferential surface and the outer circumferential surface of the secondary transfer belt 51 to form a nip portion T4. The idler roller 54 serving as a second roller and the belt driving roller 56 serving as a first roller are fixed to an inner circumferential side of the secondary transfer belt 51, tensioning the secondary transfer belt 51. The cleaning roller 31 presses a tension portion 51*a* of the secondary transfer belt 51 tensioned by the idler roller 54 and the belt driving roller 56 from an outer circumferential side toward an inner circumferential side. The cleaning roller 31 is fixed rotatably to an outer circumferential side of the secondary transfer belt 51 so as not to be displaced with respect to the idler roller 54 and the belt driving roller 56.

Regarding the external common tangents of the idler roller 54 and the belt driving roller 56, the secondary transfer belt 51 is projected inwardly of the external common tangent Z on the side of the secondary transfer belt. At least one of the rollers of the idler roller 54 and the belt driving roller 56 is provided on a same side as the cleaning roller 31 with respect to a tangent I that passes an intersection J of the counter roller 40 and a straight line H connecting a center of rotation of the counter roller 40 and a center of rotation of the cleaning roller 31. In the illustrated example, the positional relationship of the cleaning roller 31, the idler roller 54 and the belt driving roller 56 is determined so that both the idler roller 54 and the belt driving roller 56 are provided on the same side as the cleaning roller 31. The cleaning roller 31, the idler roller 54 and the belt driving roller 56 are fixed so as not to move from their positions. Thereby, the nip portion T4 long enough to allow the toner on the secondary transfer belt to move by electrophoresis and having suppressed the variation of contact area during driving of the belt can be ensured easily.

Sixth Embodiment

Figure 13:
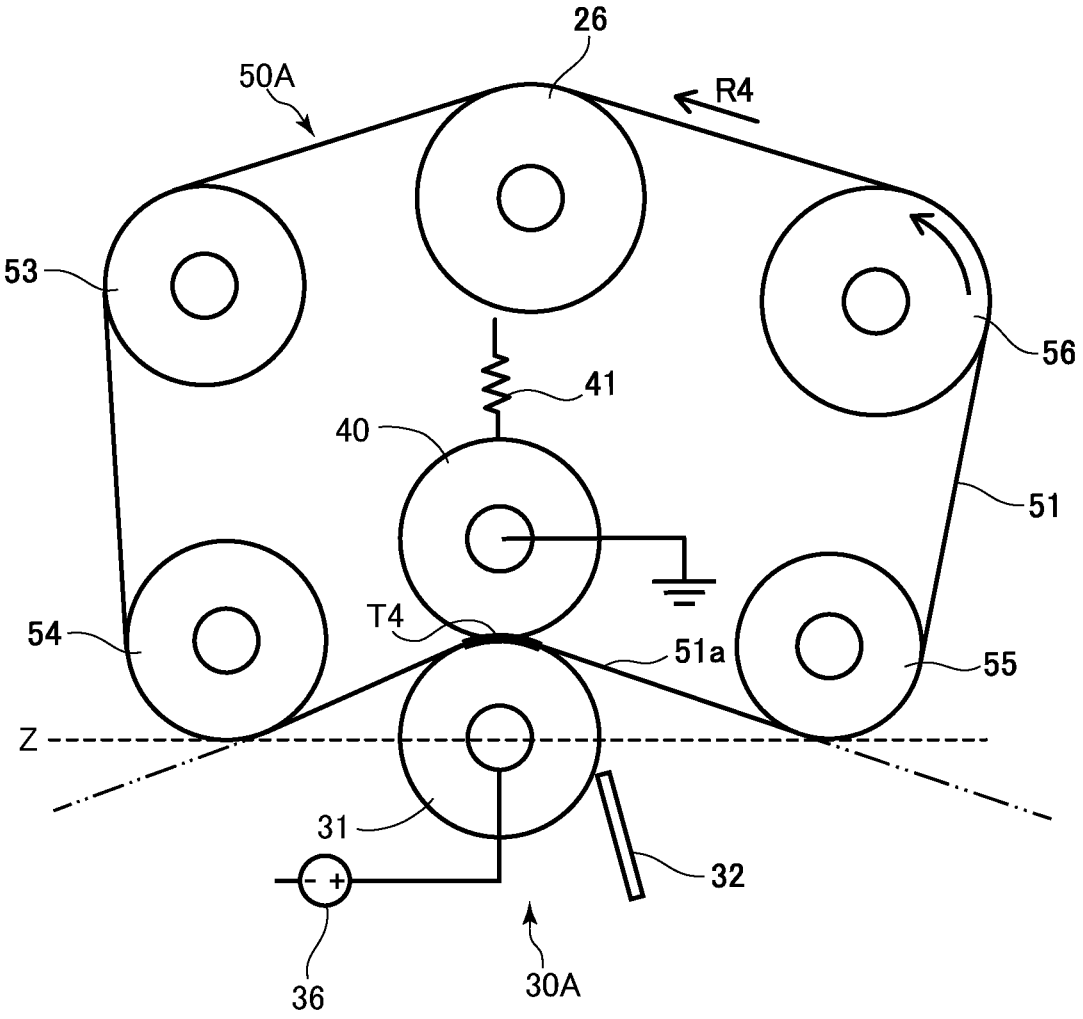
FIG. 13 is a schematic drawing illustrating a secondary transfer unit according to a sixth embodiment.

A sixth embodiment will be described with reference to FIG. 13. A secondary transfer unit 50A according to the present embodiment differs from the secondary transfer unit 50 (refer to FIG. 12) of the fifth embodiment described above in that a tension roller 55 for tensioning the secondary transfer belt 51 is arranged between the idler roller 54 and the belt driving roller 56. In this example, as illustrated in FIG. 13, the cleaning roller 31 presses the tension portion 51*a* of the secondary transfer belt 51 tensioned by the idler roller 54 serving as a second roller and the tension roller 55 serving as a first roller from the outer circumferential side to the inner circumferential side. The cleaning roller 31 is fixed rotatably to the outer circumferential side of the secondary transfer belt 51 so as not be displaced with respect to the idler roller 54 and the tension roller 55. Thereby, an effect of ensuring the nip portion T4 long enough to allow the toner on the secondary transfer belt to move by electrophoresis and having suppressed the variation of contact area during driving of the belt is obtained.

Seventh Embodiment

Figure 14:
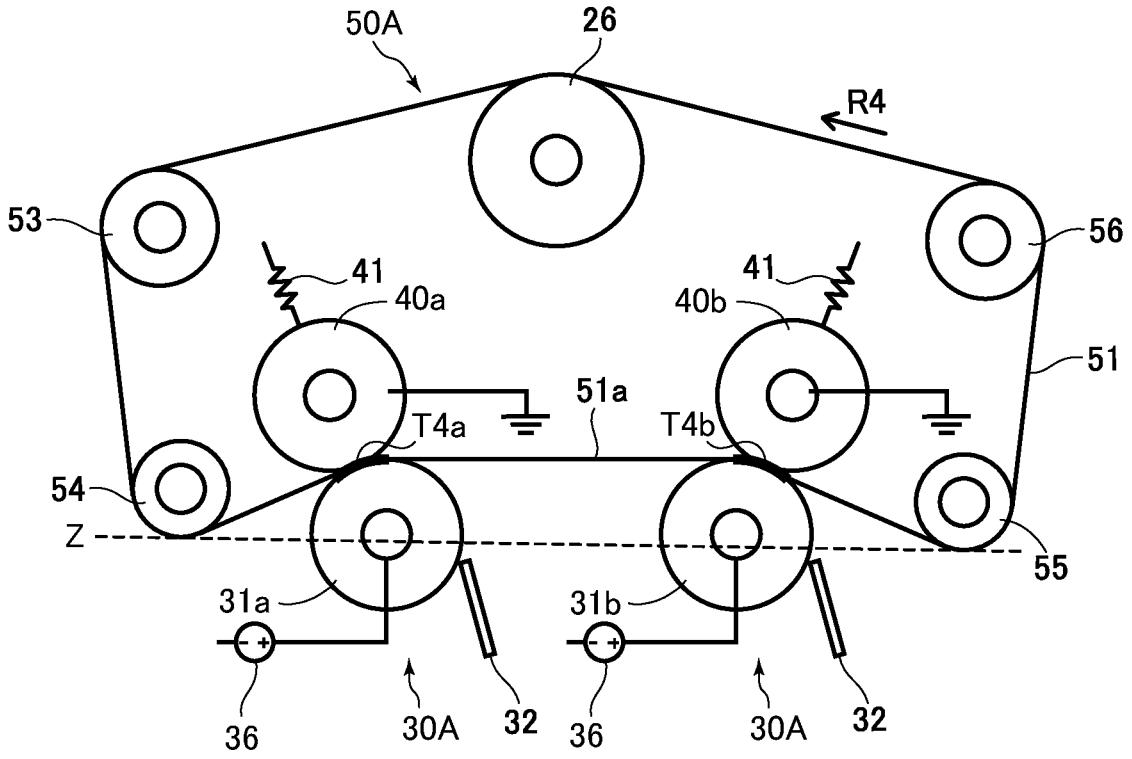
FIG. 14 is a schematic drawing illustrating a secondary transfer unit according to a seventh embodiment.

A seventh embodiment will be described with reference to FIG. 14. The secondary transfer unit 50A according to the present embodiment differs from the secondary transfer unit 50A (refer to FIG. 13) of the sixth embodiment described above in that a plurality of (two, in the illustrated example) secondary transfer cleaning devices 30A are provided along the secondary transfer belt 51. As illustrated in FIG. 14, respective cleaning rollers 31*a* and 31*b* of two secondary transfer cleaning devices 30A each press the tension portion 51*a* of the secondary transfer belt 51 tensioned by the idler roller 54 and the tension roller 55 from the outer circumferential side to the inner circumferential side. The cleaning roller 31*a* serving as an outer roller presses the tension portion 51*a* and forms the first nip portion T4*a*. The cleaning roller 31*b* serving as a first roller presses the tension portion 51*a* and forms a second nip portion T4*b* at a position downstream of the cleaning roller 31*a* in the direction of movement of the secondary transfer belt 51. A counter roller 40*a* serving as a first inner roller is abutted against the inner circumferential surface of the secondary transfer belt 51 with respect to the cleaning roller 31*a*, and a counter roller 40*b* serving as a second inner roller is abutted against the inner circumferential surface of the secondary transfer belt 51 with respect to the cleaning roller 31*b*. Toner is moved via liquid developer from the secondary transfer belt 51 by the potential difference between the cleaning roller 31*b* and the counter roller 40*b*, similar to the cleaning roller 31*a* and the counter roller 40*a*.

The cleaning rollers 31*a* and 31 *b* are fixed rotatably to the outer circumferential side of the secondary transfer belt 51 so as not to be displaced with respect to the idler roller 54 and the tension roller 55. In the present embodiment, the positional relationship of four rollers, which are the cleaning rollers 31*a* and 31*b*, the idler roller 54 and the tension roller 55, is determined so that the secondary transfer belt 51 is projected inwardly of the external common tangent Z which is positioned on the side of the secondary transfer belt. The rollers are fixed so as not to move from their positions. Thereby, the effect described above of ensuring the nip portion T4 long enough to allow the toner on the secondary transfer belt to move by electrophoresis and having suppressed the variation of contact area during driving of the belt is obtained.

Eighth Embodiment

An eight embodiment will be described with reference to FIG. 15. The secondary transfer unit 50B according to the present embodiment differs from the secondary transfer unit 50A (refer to FIG. 14) described above in that a pressure roller 57 for pressing the secondary transfer belt 51 to the outer circumferential direction is arranged between a plurality of secondary transfer cleaning devices 30A. In the present embodiment, the idler roller 54 corresponds to a second roller and the pressure roller 57 corresponds to a first roller in the secondary transfer cleaning device 30A positioned upstream in the direction of movement. Meanwhile, the pressure roller 57 corresponds to a second roller and the tension roller 55 corresponds to a first roller in the secondary transfer cleaning device 30A positioned downstream in the direction of movement.

Figure 15:
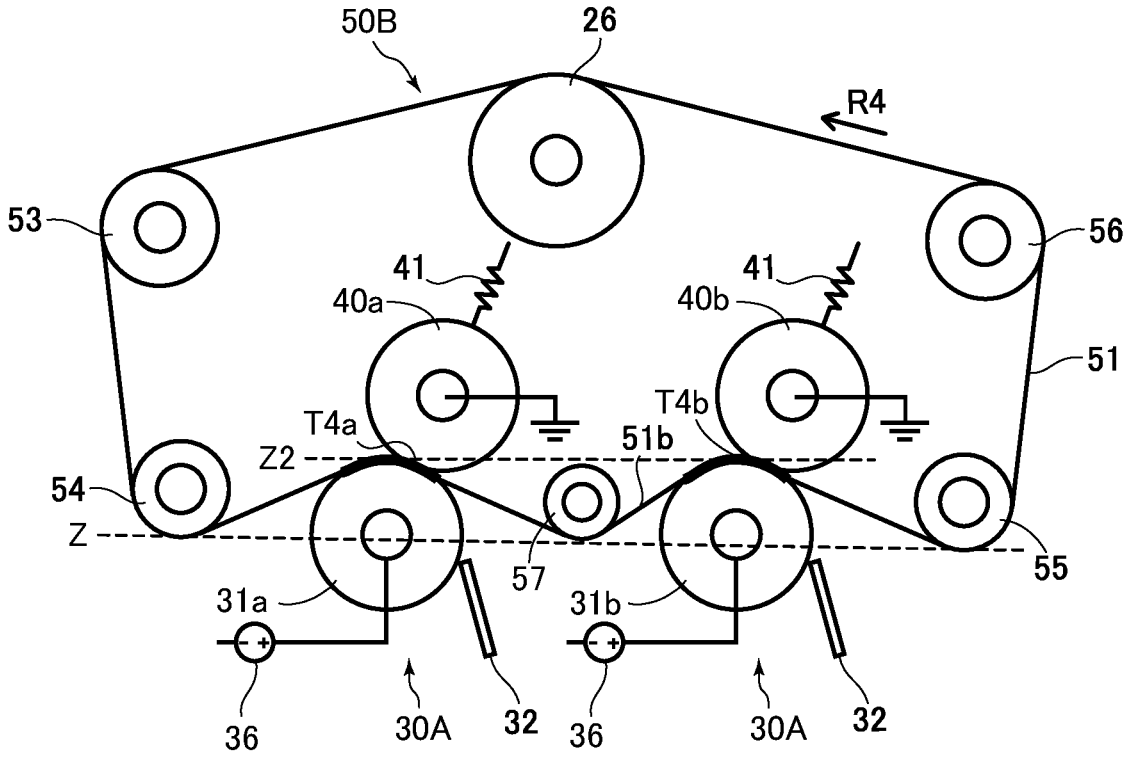
FIG. 15 is a schematic drawing illustrating a secondary transfer unit according to an eighth embodiment.

According to the present embodiment, as illustrated in FIG. 15, the pressure roller 57 presses a tension portion 51*b* of the secondary transfer belt 51 tensioned by the cleaning roller 31*a* and the cleaning roller 31*b* from the inner circumferential side toward the outer circumferential side. The pressure roller 57 is rotatably fixed at the inner circumferential side of the secondary transfer belt 51 so as not to be displaced with respect to the cleaning roller 31*a* and the cleaning roller 31*b*, and even further the idler roller 54 and the tension roller 55. Regarding the external common tangents of the cleaning roller 31*a* and the cleaning roller 31*b*, the pressure roller 57 causes the secondary transfer belt 51 to project outwardly of an external common tangent Z2 on the side of the secondary transfer belt. By providing the pressure roller 57 further as described above to form an approximately W-shaped movement path of the secondary transfer belt 51, the nip lengths of a first nip portion T4*a* and a second nip portion T4*b* can be elongated compared to the seventh embodiment (refer to FIG. 14) described above. The positional relationship of five rollers, which are the cleaning rollers 31*a* and 31*b*, the idler roller 54, the tension roller 55 and the pressure roller 57, is determined to realize the above arrangement according to the present embodiment. Thereby, an effect of ensuring the nip portions T4*a* and T4*b* long enough to allow the toner on the secondary transfer belt to move by electrophoresis and having suppressed the variation of contact area during driving of the belt is obtained.

In the seventh and eighth embodiments described above, the polarities of voltages applied from the power supply 36 to the cleaning rollers 31 of the secondary transfer cleaning devices 30A arranged on both the upstream side and the downstream side in the direction of movement of the secondary transfer belt 51 are the same.

Even according to the fifth to eighth embodiments described above, similar to the second embodiment described earlier, it is preferable to position the cleaning roller(s) 31 (31*a* and 31*b*) in an offset manner downstream of the counter roller 40 in the direction of movement.

Other Embodiments

In the first to eighth embodiments described above, an example of having applied the present invention to the belt cleaning device 30 and the secondary transfer cleaning device 30A have been illustrated, but the present disclosure is not limited thereto. The present disclosure is applicable to a primary transfer portion T1 for transferring toner to the intermediate transfer belt 21 from photosensitive drums 11Y to 11K. In this case, the photosensitive drums 11Y to 11K correspond to outer rollers and the primary transfer rollers 22Y to 22K correspond to inner rollers. Further, the embodiment is applicable to a secondary transfer portion T2 where the toner image is transferred from the intermediate transfer belt 21 to the recording material P. In this case, the secondary transfer inner roller 25 corresponds to an inner roller and the secondary transfer outer roller 26 correspond to an outer roller.

Figure 16A:
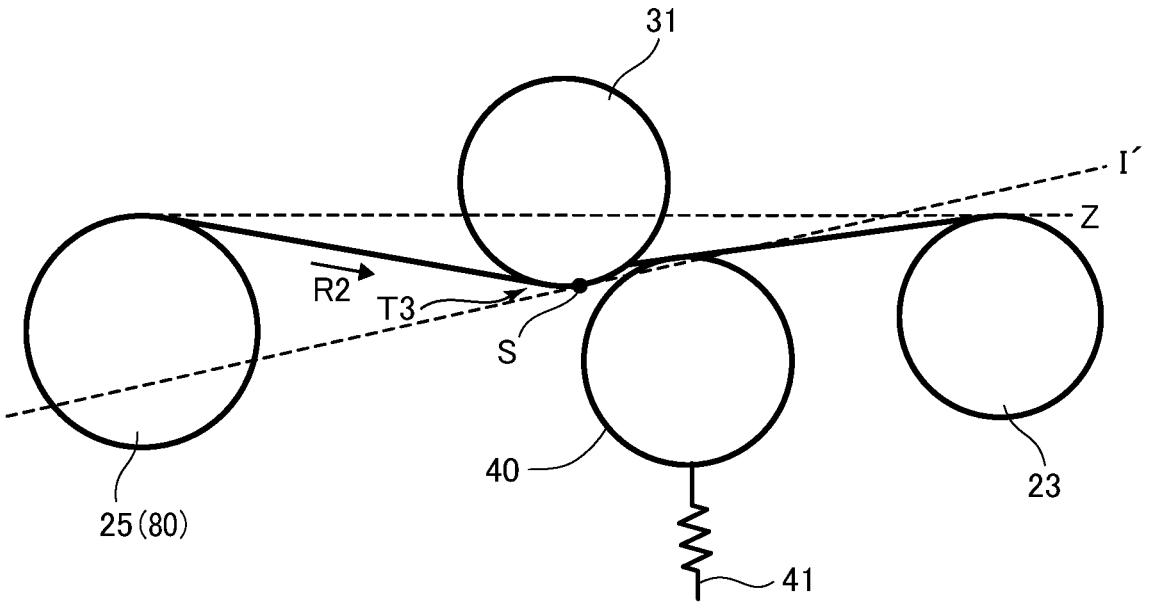
FIG. 16A is a schematic drawing illustrating an arrangement of a counter roller and a cleaning roller of a belt cleaning device according to another embodiment.
Figure 16B:
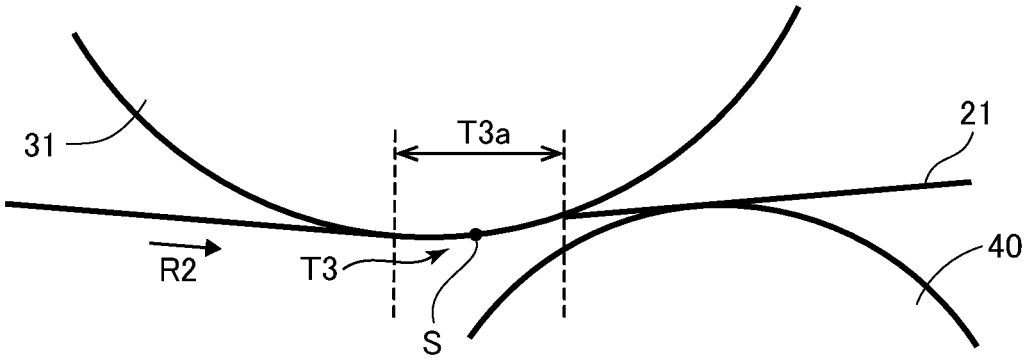
FIG. 16B is an enlarged view illustrating a nip portion of the belt cleaning device illustrated in FIG. 16A.

The first to eighth embodiments have been described assuming that the physical nip T3*b* is formed, but the present disclosure is not limited thereto. For example, the counter roller 40 may be offset further downstream so that only the tension nip T3*a* is formed between the cleaning roller 31 and the intermediate transfer belt 21 without forming the physical nip T3*b*. A belt cleaning device in which the physical nip T3*b* is not formed will be described with reference to FIGS. 16A and 16B. In FIGS. 16A and 16B, similar components as the second embodiment described earlier are denoted with the same reference numbers (refer to FIGS. 7A and 7B) and descriptions and illustrations thereof are either omitted or simplified.

A tangent I' of the cleaning roller 31 at a center position S of the nip portion T3 in the direction of movement of the intermediate transfer belt 21 is considered, as illustrated in FIG. 16A. In the present embodiment, only the tension nip T3*a* is formed between the cleaning roller 31 and the intermediate transfer belt 21 as illustrated in FIG. 16B, so the center position S in the direction of movement is positioned in the middle of the tension nip T3*a* with respect to the direction of movement of the intermediate transfer belt 21.

If the roller initially tensioning the intermediate transfer belt 21 downstream of the cleaning roller 31 in the direction of movement of the intermediate transfer belt 21 is set as a first roller, the first roller will be the counter roller 40. The counter roller 40 is arranged so that the position of abutment against the intermediate transfer belt 21 is at a position not overlapped with the tension nip T3*a* with respect to the direction of movement of the intermediate transfer belt 21 (refer to FIG. 16B). Meanwhile, if the roller initially tensioning the intermediate transfer belt 21 upstream of the cleaning roller 31 in the direction of movement of the intermediate transfer belt 21 is set as a second roller, the second roller will be the secondary transfer inner roller 25 (or the idler roller 80, refer to FIG. 11). The secondary transfer inner roller 25 (or the idler roller 80) is also arranged so that the position in which it abuts against the intermediate transfer belt 21 is at a position not overlapped with the tension nip T3*a*. Regarding tangent I' mentioned above, at least one of the counter roller 40, i.e., first roller, and the secondary transfer inner roller 25 (or the idler roller 80), i.e., second roller, should be provided on the same side as the cleaning roller 31. In the present embodiment, both the counter roller 40 and the secondary transfer inner roller 25 (or the idler roller 80) are provided on the same side as the cleaning roller 31 with respect to the tangent I'.

INDUSTRIAL APPLICABILITY

The present image forming apparatus is especially preferably applied to an apparatus using liquid developer.

The present invention is not limited to the embodiments described above, and various changes and modifications are enabled without departing from the scope of the present invention. The following claims define the scope of the present invention, which is to be accorded the broadest interpretation.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an endless belt member configured to bear a liquid developer including toner and carrier liquid on an outer circumferential surface and rotate;

an outer roller configured to form a contact portion that is in contact with the outer circumferential surface of the belt member and receive toner moved from the belt member via the liquid developer;

an inner roller configured to abut against the outer roller via the belt member;

a power supply configured to apply voltage to the outer roller or the inner roller;

a first roller adjacent to the outer roller and the inner roller on a downstream side in a direction of movement of the belt member and configured to tension the belt member; and a second roller adjacent to the outer roller and the inner roller on an upstream side with respect to the direction of movement of the belt member and configured to tension the belt member, wherein at least a portion of at least one of the first and second rollers is provided on a same side as the outer roller with respect to a tangent passing an intersection of the inner roller and a straight line connecting a center of rotation of the outer roller and a center of rotation of the inner roller. and wherein the belt member is wound around the outer roller so that a length of the contact portion in the direction of movement is configured to satisfy:

$$(\mu \times E) \times (L/P) > d,$$

in which L (m) represents the length of the contact portion, $\mu(m^2/(V \times s))$ represents mobility of toner, E (V/m) represents intensity of electric field generated at the contact portion by applying voltage, P (m/s) represents a rotational speed of the belt member and d (μm) represents liquid thickness of the liquid developer at the contact portion.

2. The image forming apparatus according to claim 1, wherein the outer roller and the first and second rollers are rotatably fixed.

3. The image forming apparatus according to claim 1, wherein the contact portion comprises a first contact portion and a second contact portion at different positions in the direction of movement of the belt member, the first contact portion is configured to be in contact with the inner roller, the second contact portion is configured not to be in contact with the inner roller, and a center position in the direction of movement of the first contact portion is arranged downstream of a center position of the second contact position in the direction of movement.

4. The image forming apparatus according to claim 1, wherein the outer roller is a metal roller.

5. The image forming apparatus according to claim 1, wherein the outer roller is configured to be in contact with the belt member with a contact pressure of 30 N or more and 300 N or less.

6. The image forming apparatus according to claim 1, wherein the outer roller has a diameter of 40 mm or less.

7. The image forming apparatus according to claim 1, wherein the belt member has a thickness of 1 mm or less.

8. The image forming apparatus according to claim 1, further comprising:

a photosensitive member, an intermediate transfer belt to which a toner image formed on the photosensitive member is primarily transferred, a transfer member configured to perform secondary transfer of the toner image transferred to the intermediate transfer belt to a recording material, and a cleaning roller configured to remove toner remaining on the intermediate transfer belt after secondary transfer according to application of voltage, wherein the belt member is the intermediate transfer belt, and the outer roller is the cleaning roller.

9. The image forming apparatus according to claim 8, wherein the intermediate transfer belt comprises an elastic layer.

10. The image forming apparatus according to claim 1, further comprising:

a photosensitive member, an intermediate transfer belt to which a toner image formed on the photosensitive member is primarily transferred, a secondary transfer belt configured to perform secondary transfer of the toner image transferred to the intermediate transfer belt to a recording material, and a cleaning roller configured to remove toner remaining on the secondary transfer belt, wherein the belt member is the secondary transfer belt, and the outer roller is the cleaning roller.

11. An image forming apparatus comprising:

an endless belt member configured to bear a liquid developer including toner and carrier liquid on an outer circumferential surface and rotate;

an outer roller configured to form a contact portion that is in contact with the outer circumferential surface of the belt member and receive toner moved from the belt member via the liquid developer;

a first inner roller configured to abut against the outer roller via the belt member;

a second inner roller configured to abut against an inner circumferential surface of the belt member;

a power supply configured to apply voltage to the outer roller or the first inner roller;

a first roller adjacent to the outer roller and the first inner roller on a downstream side in a direction of movement of the belt member and configured to tension the belt member; and a second roller adjacent to the outer roller and the first inner roller on an upstream side with respect to the direction of movement of the belt member and configured to tension the belt member, wherein at least a portion of at least one of the first and second rollers is provided on a same side as the outer roller with respect to a tangent passing an intersection of the first inner roller and a straight line connecting a center of rotation of the outer roller and a center of rotation of the first inner roller, the outer roller and the first and second rollers are rotatably fixed, the first roller is configured to abut against the outer circumferential surface of the belt member, the second inner roller is configured to abut against an inner circumferential surface of the belt member and oppose the first roller via the belt member, and toner is moved from the belt member via the liquid developer by a potential difference between the first roller and the second inner roller.

* * * * *